US005284743A

United States Patent [19]

Ohshima et al.

[11] Patent Number: 5,284,743

[45] **Date of Patent: * Feb. 8, 1994**

[54] SILVER HALIDE PHOTOGRAPHIC MATERIALS

[75] Inventors: Naoto Ohshima; Masahiro Asami, both of Kanagawa, Japan

[73] Assignee: Fuji Photo Film Co., Ltd., Minami ashigara, Japan

[ * ] Notice: The portion of the term of this patent subsequent to Jul. 3, 2007 has been disclaimed.

[21] Appl. No.: 261,447

[22] Filed: Oct. 19, 1988

[30] Foreign Application Priority Data

Oct. 19, 1987 [JP] Japan ..... 62-263318

[51] Int. Cl.[5] ..... G03C 1/035

[52] U.S. Cl. ..... 430/567; 430/569; 430/584; 430/603; 430/605; 430/611

[58] Field of Search ..... 430/605, 567, 569, 611, 430/603, 584

[56] References Cited

U.S. PATENT DOCUMENTS

| | | | |
|---|---|---|---|
| 4,564,591 | 1/1986 | Tanaka et al. | 430/567 |
| 4,605,610 | 8/1986 | Klötzer | 430/376 |
| 4,746,603 | 5/1988 | Yamashita et al. | 430/603 |
| 4,849,324 | 7/1989 | Aida et al. | 430/445 |
| 4,863,844 | 9/1989 | Okumura et al. | 430/569 |
| 4,939,080 | 7/1990 | Hioki et al. | 430/576 |
| 4,960,689 | 10/1990 | Nishikawa et al. | 430/603 |
| 5,057,402 | 10/1991 | Shiba et al. | 430/611 |

FOREIGN PATENT DOCUMENTS

| | | | |
|---|---|---|---|
| 0080905 | 6/1983 | European Pat. Off. . | |
| 0244184 | 11/1987 | European Pat. Off. . | |
| 1151782 | 5/1969 | United Kingdom . | |
| 2206700 | 1/1989 | United Kingdom | 430/567 |

OTHER PUBLICATIONS

Research Disclosure, No. 181, May 1971, pp. 265-268.
Photographic Science and Engineering, vol. 24, No. 6, Nov./Dec. 1980, pp. 265-267.
Photographic Science and Engineering, vol. 27, No. 2, Mar./Apr. 1983, pp. 81-94.

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A silver halide photographic material comprising at least one photosensitive emulsion layer contains silver halide grains on a support. In the silver halide photographic material, (1) the silver halide grains are prepared in the presence of iridium compounds, (2) the silver halide grains consist of silver chlorobromide which is essentially free of silver iodide, (3) at least 90 mol% of all silver halide from which the silver halide grains are made is silver chloride, (4) the silver halide grains have localized phase in which the silver bromide content exceeds at least 20 mol%, (5) the localized phase is precipitated together with at least 50% of all the iridium which is added during the preparation of the silver halide grains, and (6) the surface of the silver halide grains is chemically sensitized to the extent that the grains are essentially of the surface latent image type.

14 Claims, No Drawings

SILVER HALIDE PHOTOGRAPHIC MATERIALS

FIELD OF THE INVENTION

This invention concerns silver halide photographic materials and, more precisely, it concerns silver halide photographic materials which have excellent rapid processing characteristics, high speed and high contrast, which exhibit little reciprocity law failure and which, moreover, have excellent handling properties.

BACKGROUND OF THE INVENTION

The silver halide photographic materials and methods for forming images using these materials which are available at the present time are useful in many and various fields. The halogen composition of the silver halide emulsions used in many of these photosensitive materials often include silver iodobromide, silver chloroiodobromide or silver bromochloride, and other silver halides based principally on silver bromide, in order to achieve the required high speeds.

On the other hand, with the products which are used in markets where there is a great demand for finishing large numbers of prints in a short period of time, such as the color printing paper type photosensitive materials, silver bromide or silver chlorobromide which is substantially silver iodide free is used because of the need to realize high processing speeds.

In recent years, the demand for increased processing speeds in connection with color printing papers has increased, and much research has been done in this connection. Thus it is well known that the development rate can be greatly increased by raising the silver chloride content of the silver halide emulsion which is being used.

However, silver halide emulsions which have a high silver chloride content are liable to fogging and it is difficult to achieve high speeds with normal chemical sensitization with these emulsions. Further, they are known to suffer from problems with reciprocity law failure which causes, for example, changes in speed and gradation depending on the exposure luminance.

Various techniques have been developed with a view to overcoming the disadvantages of the silver halide emulsions which have a high silver chloride content as described above.

Thus it is indicated in JP-A-58-95736, U.S. Pat. No. 4,564,591 (JP-A-58-108533), JP-A-61-222844 and U.S. Pat. No. 4,590,155 (JP-A-60-222845) (the term "JP-A" as used herein means an "unexamined published Japanese patent application") that the provision of silver halide grain structures such that there is a layer or phase which has a high silver bromide content is effective for overcoming the disadvantages of silver halide emulsions which have a high silver chloride content. Thus, the introduction of a layer or phase which has a high silver bromide content has various effects on the photographic performance of a silver halide emulsion which has a high silver chloride content, but it has little improving effect in terms of reciprocity law failure.

It is also known that the doping of silver halide grains with iridium is effective for improving a silver halide emulsion in respect of reciprocity law failure. For example, in JP-B-43-4935 (the term "JP-B" as used herein means "examined Japanese patent publication") it is indicated that images which have almost constant gradation can be obtained over a wide range of exposure times with photographic materials in which a trace amount of an iridium compound has been added during the precipitation or ripening of the silver halide emulsion. However, it is indicated on page 201 of volume 33 of the *Journal of Photographic Science* by Twikkey that latent image intensification occurs during a comparatively short interval of time from 15 seconds to about 2 hours after exposure in the case of iridium doped silver halide emulsions which have a high silver chloride content. For example, changes inevitably occur in the photographic performance as a result of changing the time interval between exposure and processing as a result of this effect and this is undesirable in practice with photosensitive materials which are to be used as color printing papers.

Examples of the iridium doping of silver chloroiodobromide emulsions which have a comparatively high silver chloride content have been disclosed in U.S. Pat. No. 4,126,472 (JP-A-50-116025), JP-A-56-25727, U.S. Pat. No. 4,469,783 (JP-A-58-211753), JP-A-58-215641, U.S. Pat. No. 4,621,041 (JP-A60-19141) and JP-A-61-47941, but in none of these cases is the aforementioned problem of reciprocity law failure overcome.

SUMMARY OF THE INVENTION

Hence, the first aim of the invention is to provide silver halide photographic materials which have excellent high speed processing characteristics and which have a high contrast at high speed.

The second aim of the invention is to provide silver halide photographic materials in which the variation in speed and gradation due to changes in the exposure luminance is slight.

The third aim of the invention is to provide silver halide photographic materials in which the variation in speed and gradation due to the time interval between exposure and processing is slight.

The aims of the invention are achieved by providing a silver halide photographic material comprising at least one photosensitive emulsion layer which contains silver halide grains on a support, wherein:

(1) the silver halide grains are prepared in the presence of iridium compounds, (2) the silver halide grains consist of silver chlorobromide which is substantially free of silver iodide, (3) at least 90 mol% of all silver halide from which the silver halide grains are made is silver chloride, (4) the silver halide grains have a localized phase in which the silver bromide content exceeds at least 20 mol%, (5) the localized phase is precipitated together with at least 50% of all the iridium which is added during the preparation of the silver halide grains, and (6) the surface of the silver halide grains is chemically sensitized to the extent that the grains are substantially of the surface latent image type.

DETAILED DESCRIPTION OF THE INVENTION

Water soluble iridium compounds can be used as the iridium compounds which are used in the invention. For example, it is possible to use iridium(III) halides, iridium(IV) halides, iridium complex salts which have halogens, amines or oxalates etc. as ligands, for example hexachloroiridium(III) or (IV) complex salts, hexaammineiridium(III) or (IV) complex salts, trioxalatoiridium(III) or (IV) complex salts etc. Combinations of the (III and (IV) valent compounds selected arbitrarily from among these compounds can be used in this invention. These iridium compounds can be dissolved in water or in a suitable solvent for use, but steps are usually taken to stabilize the solution of iridium compounds, which is to say that methods in which hydrogen halide solutions (for example hydrochloric acid, hydrobromic acid, hydrofluoric acid etc.) or alkali halides (for example KCl, NaCl, KBr, NaBr etc.), are added can be used. Moreover, separate silver halide grains which have been doped with iridium previously can be added and dissolved during the manufacture of silver halide grains in accordance with this invention instead of using water soluble iridium compounds.

The total amount of iridium compound added during the manufacture of the silver halide grains in accordance with this invention is suitably from $5\times10-9$ to $1\times10-4$ mol, preferably from $1\times10-8$ to $1\times10-4$ mol, and most desirably from $5\times10-8$ to $5\times10-6$ mol, per mol of silver halide which is ultimately formed.

The halogen composition of the silver halide grains in this invention must be such that the grains consist of substantially silver iodide free silver chlorobromide in which at least 90 mol% of all of the silver halide from which the silver halide grains are made is silver chloride. Here, the term "substantially silver iodide free" signifies a silver iodide content not exceeding 1.0 mol%. The preferred halogen composition of the silver halide grains is that of an substantially silver iodide free silver chlorobromide in which at least 95 mol% of all of the silver halide from which the silver halide grains are made is silver chloride.

The silver halide grains in this invention must have a localized phase in which the silver bromide content exceeds at least 20 mol%. A term of a "localized phase" in the present invention means a phase having higher silver bromide content in the silver bromide grains comparing with those in other phase. The location of this localized phase which has a high silver bromide content can be selected freely according to the intended purpose of the grains, and it may take the form of a surface phase or a sub-surface phase, or it may be divided between an internal and a surface or sub-surface phase. Furthermore, the localized phase may have a layer-like structure such as to enclose the silver halide grain, internally or at the surface, or it may have a discontinuous, isolated structure. In a preferred example of the arrangement of the localized phase which has a high silver bromide content, the localized phase in which the silver bromide content exceeds at least 20 mol% is grown epitaxially on the surfaces of silver halide grains.

The silver bromide content of the localized phase must exceed 20 mol%, but if it is too high the photosensitive material may become liable to desensitization on the application of pressure, and this can result in the appearance of undesirable characteristics in photographic materials in that the speed and gradation may be affected and vary as a result of fluctuations in the composition of the processing baths. In consideration of these points, the silver bromide content of the localized phase is preferably within the range from 20 to 60 mol%, and most desirably it is within the range from 30 to 50 mol%. The silver bromide content of the localized phase can be analyzed using X-ray diffraction methods (for example see the Japanese Chemical Society publication "New Experimental Chemistry Series 6, Structural Analysis", published by Maruzen) or using the XPS method (for example, see "Surface Analysis,—The Application of IMA, Auger Electron—Photoelectron Spectra", published by Kodansha). The localized phase is preferably made using from 0.1 to 20 mol% of all of the silver used to form the silver halide grains of this invention, and it is most desirably made using from 0.5 to 7 mol% of the total amount of silver.

The interface between the localized phase which has a high silver bromide content and any other phase may consist of a distinct phase boundary, or there may be a short transition zone in which the halogen composition changes gradually.

Various methods can be employed to form a localized phase which has a high silver bromide content of this type. For example, the local phase can be formed by reacting a soluble silver salt with a soluble halide salt using either the one side mixing method or the simultaneous mixing method. Moreover, the local phases can be formed using the so-called conversion method which includes a process in which a silver halide which has been formed already is converted to a silver halide which has a lower solubility product. Alternatively, the local phase can be formed by adding fine silver bromide grains or fine silver chlorobromide grains and carrying out a recrystallization on the surface of silver chloride grains.

The localized phase must be precipitated together with at least 50% of all of the iridium which is added during the preparation of the aforementioned silver halide grains. Here, the statement that "the localized phase is precipitated together with the iridium" means that the iridium compound is supplied at the same time as the silver or halogen is being supplied to form the localized phase, immediately before the supply of the silver or halogen, or immediately after the supply of the silver or halogen. The iridium compound(s) may be present during the formation of phases other than the localized phase which has a high silver bromide content, but the localized phase must be precipitated together with at least 50% of all of the iridium which is added. Cases in which the localized phase is precipitated together with at least 80% of all the iridium added are preferred, and cases in which the localized phase is precipitated together with all of the iridium added are most desirable.

In more detail, the localized phase of the silver halide grains is preferably formed by adding other silver halide grains, for example, fine silver chlorobromide grains which have been doped with iridium.

The silver halide grains in this invention must have the surface sensitized chemically to such an extent that they are substantially of the surface latent image type. The chemical sensitization can be carried out using the sulfur sensitization methods in which compounds which contains sulfur which can react with active gelatin and silver (for example thiosulfates, thioureas, mercapto compounds, rhodanines) are used, the reduction sensitization methods in which reducing substances (for example stannous salts, amines, hydrazine derivatives, formamidine sulfinic acid, silane compounds) are used, or the precious metal sensitizing methods in which metal compounds (for example, complex salts of metals of group VIII of the periodic table, such as Pt, Ir, Pd, Rh, Fe etc., as well as gold) are used, and these methods may be used individually or in combination. Of these methods the sulfur sensitization method is preferred.

Photosensitive materials made from silver halide grains which have been prepared in this way have excellent rapid processing characteristics, high speed and contrast, little reciprocity law failure and, moreover, the latent image stability is high and they ave excellent handling properties. These features are different from the normal features of conventional silver chloride emulsions and the findings are therefore surprising.

The silver halide grains in this invention preferably have the (100) surface or the (111) surface as the outer surface, or they may have both of these surfaces as the outer surface, and the use of silver halide grains which have higher order surfaces is especially desirable. The silver halide grains in this invention may have a regular crystalline form such as a cubic, octahedral, dodecahedral or tetradecahedral form, or they may have an irregular form such as spherical form, or they may be tabular grains, and emulsions in which tabular grains of which the length/thickness ratio is at least 5, and preferably at least 8, account for at least 50% of the total projected area of the grains are the best.

The size of the silver halide grains in this invention may be within the range normally used, but grains of which the average grain size is from 0.1 μm to 1.5 μm are preferred. The grain size distribution may be polydisperse or mono-disperse, but mono-dispersions are preferred. The grain size distribution feature which represents the extent of mono-dispersion is the ratio of the statistical standard deviation (s) and the average grain size (d), i.e., ($s/\bar{d}$), and the value of this ratio is preferably not more than 0.2, and most desirably not more than 0.15.

Cadmium salts, zinc salts, thallium salts, lead salts, rhodium salts or complex salts thereof, iron salts or complex salts thereof etc. can also be present during the formation or physical ripening processes of the silver halide grains of this invention.

Various compounds can be included in the photographic emulsions used in the invention with a view to preventing the occurrence of fogging during the manufacture, storage or processing of the photosensitive material or with a view to the stabilization of photographic characteristics. Thus many compounds which are known as anti-fogging agents or stabilizers, such as the azoles (for example benzothiazolium salts, niroimidazoles, nitrobenzimidazoles, chlorobemzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, (especially 1-phenyl-5-mercaptotetrazoles etc.), mercaptopyrimidines, mercaptotriazoles etc., thioketone compounds such as oxazolinethione for example, azaindenes such as triazaindenes, tetra-aza-indenes (especially 4-hydroxy substituted (1,3,3*a*,7)-tetra-azaindene), penta-azaindenes etc. for example, and benzenethiosulfonic acid, benzenesulfinic acid and benzene sulfonic acid amide etc.

Of these, the addition of the mercaptoazoles which can be represented by the general formulae [I], [II] or [III] given below to the silver halide coating liquids is preferred. The amounts added are preferably within the range of from $1\times10-5$ to $5\times10-2$, and most desirably within the range from $1\times10-4$ to $1\times10-2$ mol, per mol of silver halide.

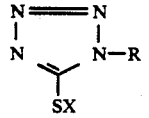

Formula [I]

In this formula, R represents an alkyl group, alkenyl group or an aryl group. X represents a hydrogen atom, an alkali metal atom, an ammonium group or a precursor. The alkali metal atom is, for example, a sodium atom, potassium atom etc., and the ammonium group is, for example, a tetramethylammonium group or a trimethylbenzylammonium group. Furthermore the precursor is a group which is such that X=H or an alkali metal under alkaline conditions, being for example an acetyl group, cyanoethyl group, methanesulfonylethyl group etc.

The alkyl groups and alkenyl groups included among the groups represented by R may be unsubstituted or substituted groups, and they may also be alicyclic groups. Possible substituent groups for the substituted alkyl groups include halogen atoms, nitro groups, cyano groups, hydroxyl groups, alkoxy groups, aryl groups, acylamino groups, alkoxycarbonylamino groups, ureido groups, amino groups, heterocyclic groups, acyl groups, sulfamoyl groups, sulfonamido groups, thioureido groups, carbamoyl groups, alkylthio groups, arylthio groups, heterocyclic thio groups, or carboxylic acid groups, sulfonic acid groups or the salts of these groups, etc.

The above mentioned ureido groups, thioureido groups, sulfamoyl groups, carbamoyl groups and amino groups may be unsubstituted groups or they may be N-alkyl substituted groups or N-aryl substituted groups. A phenyl group and substituted phenyl groups are examples of aryl groups represented by R and the alkyl groups and the substituent groups for the alkyl groups indicated above can be present as substituent groups.

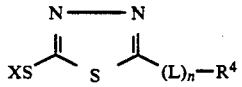

Formula [II]

In this formula, L represents a divalent linking group and $R^4$ represents a hydrogen atom, an alkyl group, an alkenyl group or an aryl group and X is as defined in formula [1]. The alkyl groups, alkenyl groups and aryl groups for $R^4$ are the same as those described for R in connection with formula [I].

Typical examples of divalent linking groups include:

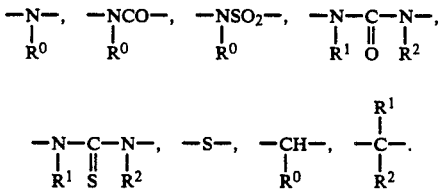

Groups consisting of combinations of these groups are also included.

Here n has a value of 0 or 1 and $R^0$, $R^1$ and $R^2$ each represents a hydrogen atoms, an alkyl group having 1 to 8 carbon atoms or an aralkyl group such as benzyl group, phenetyl group, etc.

Formula [III]

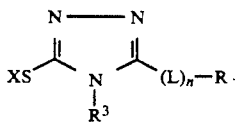

In this formula, R and X have the same meaning as in formula [I], and L has the same meaning as in formula [II]. $R^3$ has the same meaning as R and these groups may be the same or different.

Actual examples of compounds which can be represented by the formulae [I], [II]and [III]are indicated below, but the invention is not limited by these examples.

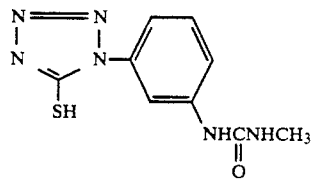

(I-1)

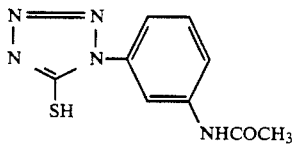

(I-2)

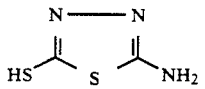

(II-1)

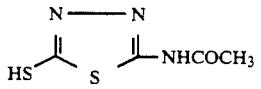

(II-2)

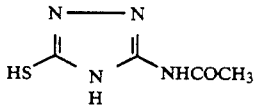

(III-1)

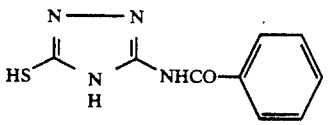

(III-2)

The invention can be applied to black and white photosensitive materials, but it is preferably applied to multi-layer multi-color photographic materials which have at least two layers of different spectral sensitivities on a support. Multi-layer natural color photographic materials normally have at least one red sensitive emulsion layer, at least one green sensitive emulsion layer and at least one blue sensitive emulsion layer on a support. The order in which these layers are established can be chosen arbitrarily, as required. A cyan forming coupler is normally included in the red sensitive emulsion layer, a magenta forming coupler is normally included in the green sensitive emulsion layer and a yellow forming coupler is normally included in the blue sensitive layer, but different combinations can be adopted according to the particular case.

The methine dyes such as the cyanine dyes and merocyanine dyes etc. normally used for photographic purposes can be used as spectrally sensitizing dyes, but the use of the cyanine dyes which can be represented by the formula [IV] below is especially desirable in this invention. These dyes are added during the manufacture of the silver halide emulsion, and preferably before the washing of the emulsion or before chemical sensitization.

Formula [IV]

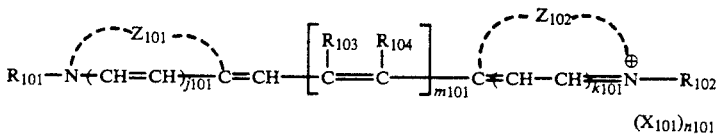

In this formula, $Z_{101}$ and $Z_{102}$ each represents a group of atoms which is required to form a heterocyclic nucleus.

The heterocyclic nuclei are preferably five or six membered rings (which may be linked to a condensed ring) which contain, as well as nitrogen atoms, sulfur atoms, oxygen atoms, selenium atoms or thallium atoms as heterocyclic atoms.

Actual examples of the aforementioned heterocyclic nuclei include a thiazole nucleus, benzothiazole nucleus, naphthothiazole nucleus, selenazole nucleus, oxazole nucleus, benzoxazole nucleus, naphthoxazole nucleus, imidazole nucleus, benzimidazole nucleus, naphthimidazole nucleus, 4-quinoline nucleus, pyrroline nucleus, pyridine nucleus, tetrazole nucleus, indolenine nucleus, benzimidolenine nucleus, indole nucleus, tetrazole nucleus, benzotetrazole nucleus, naphthotetrazole nucleus etc.

$R_{101}$ and $R_{102}$ each represents an alkyl group, alkenyl group, alkynyl group or an aralkyl group. These groups and the groups mentioned below are used in the sense that they include the respective substituted groups. For example, in the case of the alkyl groups, these include unsubstituted and substituted alkyl groups, and the groups may have a linear or branched chain or they may be cyclic groups. The alkyl groups preferably have from 1 to 8 carbon atoms and are, for example, methyl group, ethyl group, pentyl group, 3-sulfopropyl group.

Furthermore, actual examples of the substituent groups of the substituted alkyl groups include halogen atoms (chlorine atoms, bromine atoms, fluorine atoms etc.), cyano groups, alkoxy groups, substituted and unsubstituted amino groups, carboxylic acid groups, sulfonic acid groups, hydroxyl groups etc., and these groups may be substituted in combinations of the same group or as a plurality of different groups.

Actual examples of alkenyl groups include a vinylmethyl group.

Actual examples of aralkyl groups include a benzyl group and a phenethyl group.

Moreover, $m_{101}$ represents 0 or an integer of value 1, 2 or 3. When $m_{101}$ represents 1 then $R_{103}$ represents a hydrogen atom, lower alkyl group, aralkyl group or aryl group.

Actual examples of the aforementioned aryl groups include substituted and unsubstituted phenyl groups.

When $m_{101}$ represents 1, 2 or 3, then $R_{104}$ represents a hydrogen atom, lower alkyl group or aralkyl group. Moreover, when $m_{101}$ represents 2 or 3, $R_{103}$ represents a hydrogen atom, and $R_{104}$ represents a hydrogen atom, lower alkyl group or aralkyl group, or it may be linked to $R_{102}$ to form a five or six membered ring. Furthermore, when $m_{101}$ represents 2 or 3 and $R_{104}$ represents a hydrogen atom, $R_{103}$ may be connected to another $R_{103}$ to form a carbocyclic or heterocyclic ring. These rings are preferably five or six membered rings. Moreover, $j_{101}$ and $k_{101}$ represent 0 or 1, $x_{101}$ represents an acid anion and $n_{101}$ represents 0 or 1.

Of these dyes, the compounds which have a reduction potential of −1.23 (V vs S.C.E.) or more negative are preferred as red sensitizing dyes, and those of these dyes which have a reduction potential of −1.27 or more negative are especially desirable. In terms of chemical structure, the benzothiadicarbocyanine dyes in which two methine groups of the pentamethine linking groups are linked together to form a ring are preferred. Electron donor groups, such as alkyl groups and alkoxy groups, may be bonded onto the benzene ring of the benzothiazole nucleus of the dye.

Measurement of the reduction potential is carried out using phase discrimination type second harmonic alternating current polarography. A mercury dropping electrode is used for the measuring electrode, a saturated calomel electrode is used for the reference electrode and platinum is used for the counterelectrode.

Measurement of reduction potentials using phase discrimination type second harmonic alternating current polarography with platinum for the measuring electrode has been described on pages 27 to 35 of volume 30 of the Journal of Imaging Science (1986).

Typical examples of red sensitizing dyes which can be used in the invention are given below.

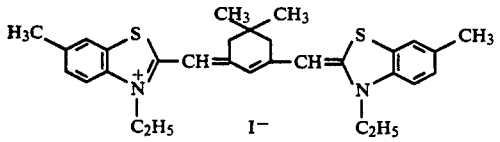
(S-1)

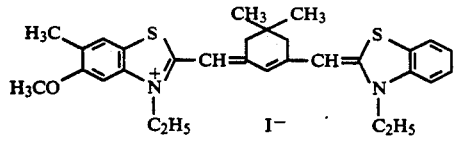
(S-2)

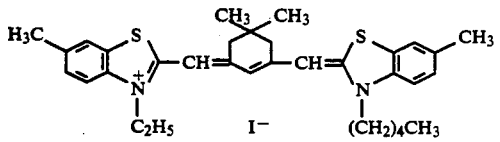
(S-3)

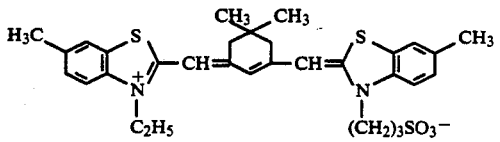
(S-4)

Yellow couplers, magenta couplers and cyan couplers which form the colors yellow, magenta and cyan respectively on coupling with the oxidized form of a primary aromatic amine are normally used in color photosensitive materials.

Of the yellow couplers which can be used in this invention, the acylacetamideerivatives such as benzoylacetanilide and pivaloylacetanilide etc. are preferred.

Among these, the couplers represented by the formulae [Y-1] and [Y-2] below are ideal as yellow couplers.

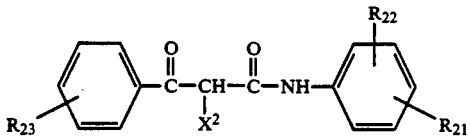
[Y-1]

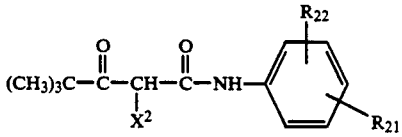
[Y-2]

In these formulae, $X^2$ represents a hydrogen atom or a coupling elimination group. $R_{21}$ represents a non-diffusible group which has a total number of from 8 to 32 carbon atoms, and $R_{22}$ represents a hydrogen atom, one or more halogen atoms, a lower alkyl group, a lower alkoxy group or a non-diffusible group which has a total of from 8 to 32 carbon atoms. $R_{23}$ represents a hydrogen atom or a substituent group. When there are two or more $R_{23}$ groups they may be the same or different.

Details of pivaloylacetanilide type yellow couplers have been disclosed in the specifications of U.S. Pat. No. 4,622,287 (from column 3, line 15, to column 8, line 39) and U.S. Pat. No. 4,623,616 (from column 14, line 50, to column 19, line 41).

Details of benzoylacetanilide type yellow couplers have been disclosed in U.S. Pat. Nos. 3,408,194, 3,933,501, 4,046,575, 4,133,958 and 4,401,752 etc.

Actual examples of pivaloylacetanilide type yellow couplers include the illustrative compounds (Y-1) to (Y-39) disclosed in columns 37 to 54 of the specification of the aforementioned U.S. Pat. No. 4,622,287, and of these compounds those designated as (Y-1), (Y-4), (Y-6), (Y-7), (Y-15), (Y-21), (Y-22), (Y23), (Y-26), (Y-35), (Y-36), (Y-37), (Y-38) and (Y-39) etc. are preferred.

There are also the illustrative compounds (Y-1) to (Y-33) disclosed in columns 19 to 24 of the specification of the aforementioned U.S. Pat. No. 4,623,616, and of these, those designated as (Y-2), (Y-7), (Y-8), (Y-12), (Y-20), (Y-21), (Y-23) and (Y-29) etc. are preferred.

Other desirable compounds include the typical example (34 disclosed in column 6 of the specification of U.S. Pat. No. 3,408,194, illustrative compounds (16) and (19) disclosed in column 8 of the specification of U.S. Pat. No. 3,933,501, illustrative compound (9) disclosed in columns 7 and 8 of the specification of U.S. Pat. No. 4,046,575, illustrative compound (1) disclosed in columns 5 and 6 of the specification of U.S. Pat. No. 4,133,958, illustrative compound 1 disclosed in column 5 of the specification of U.S. Pat. No. 4,401,752, and the compounds a) to g) shown below.

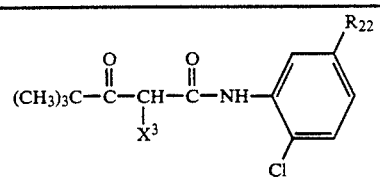

| Compound | $R_{22}$ | $X^3$ |
|---|---|---|
| a | $-COOCH(CH_3)COOC_{12}H_{25}$ | 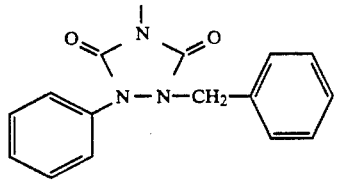 |
| b | $-COOCH(C_4H_9)COOC_{12}H_{25}$ | As above |
| c | 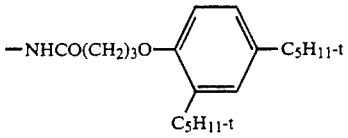 | 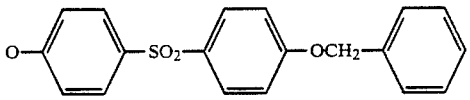 |
| d | As above | 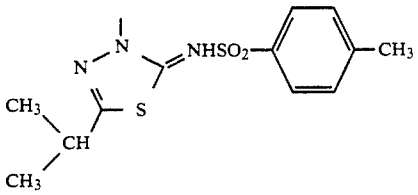 |
| e | As above | 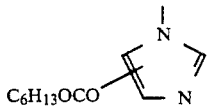 |
| f | $-NHSO_2C_{12}H_{25}$ | 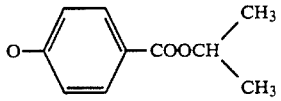 |
| g | $-NHSO_2C_{16}H_{23}$ | 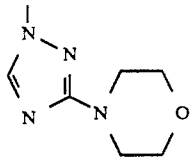 |

Those among the above mentioned couplers which have a nitrogen atom for the elimination atom are especially desirable.

Furthermore, the oil protected type, indazolone based and cyanoacetyl based couplers, and especially the 5-pyrazolone based and the pyrazoloazole based couplers such as the 5-pyrazolotriazoles can be used for the magenta couplers which are used in the invention. The 5-pyrazolone based couplers which are substituted with an arylamino group or an acylamino group in the 3-position are preferred from the point of view of the hue of the colored dye and the color density, and typical examples of these have been disclosed in U.S. Pat. Nos. 2,311,082, 2,343,703, 2,600,788, 2,908,573, 3,062,653, 3,152,896 and 3,936,015 etc. The nitrogen atom elimination groups disclosed in U.S. Pat. No. 4,310,619 and the arylthio groups disclosed in U.S. Pat. No. 4,351,897 or WO 88/04795 are the preferred elimination groups for the two equivalent 5-pyrazolone based couplers. Furthermore, high color densities can be obtained with the 5-pyrazolone based couplers which have ballast groups as disclosed in European Patent 73,636.

The benzolobenzimidazoles disclosed in U.S. Pat. No. 3,369,879, and preferably the pyrazolo[5,1-c]-[1,2,4]triazoles disclosed in U.S. Pat. No. 3,725,067, the pyrazolotetrazoles disclosed in *Research Disclosure,* 24220 (June 1984) and the pyrazolopyrazoles disclosed in *Research Disclosure,* 24230 (June 1984) can be used as pyrazoloazole based couplers. All of the couplers described above may take the form of a polymeric coupler.

Typical examples of these compounds can be represented by the formulae [M-1], [M-2]or [M-3] indicated below.

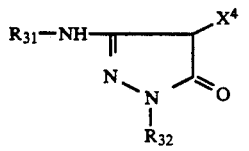
[M-1]

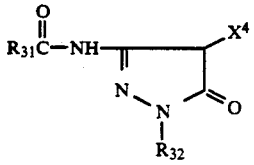
[M-2]

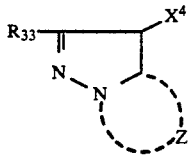
[M-3]

Here $R_{31}$ represents a non-diffusible group which has a total of from 8 to 32 carbon atoms, and $R_{32}$ represents a phenyl group or a substituted phenyl group. $R_{33}$ represents a hydrogen atom or a substituent group. Z represents a group of non-metal atoms which is required to form a five membered azole ring which contains from 2 to 4 nitrogen atoms, and the azole ring may have substituent groups (including condensed rings).

$X^4$ represents a hydrogen atom or an elimination group. Details of the substituent groups of $R_{33}$ and the substituent groups of the azole ring have been disclosed for example in the specifications of U.S. Pat. No. 4,540,654, from line 41 of column 2 to line 27 of column 8.

Among the pyrazoloazole based couplers, the imidazo[1,2-b]pyrazoles disclosed in U.S. Pat. No. 4,500,630 are preferred in view of the small absorbance on the yellow side of the colored dye and their light fastness, and the pyrazolo[1,5-b][1,2,4]triazoles disclosed in U.S. Pat. No. 4,540,654 are especially desirable.

Moreover, the use of the pyrazolotriazole couplers which have a branched alkyl group bonded directly in the 2-, 3- or 6-position of the pyrazolotriazole ring as disclosed in JP-A-61-65245, the pyrazoloazole couplers in which a sulfonamido group is included in the molecule as disclosed in JP-A-61-65246, the pyrazoloazole couplers which have an alkoxyphenylsulfonamido ballast group as disclosed in JP-A-61-147254 and the pyrazolotriazole couplers which have an alkoxy group or an aryloxy group in the 6-position as disclosed in European Patent Application 226,849A is desirable.

Actual examples of these couplers are given below.

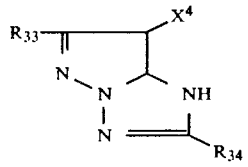
| Compound | $R_{33}$ | $R_{34}$ | $X^4$ |
|---|---|---|---|
| M-1 | $CH_3$— | 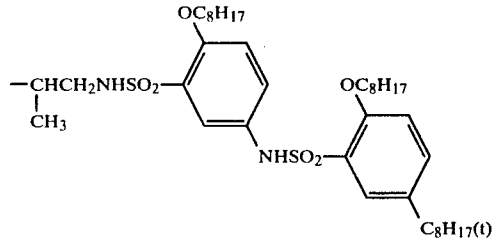 | Cl |
| M-2 | As above | 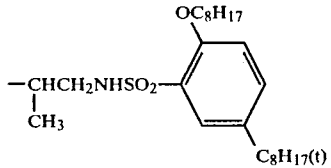 | As above |
| M-3 | As above | 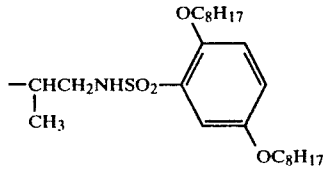 | 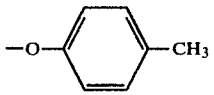 |
| M-4 | 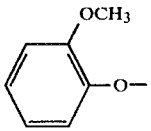 | 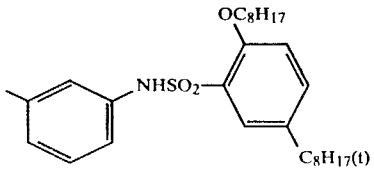 | 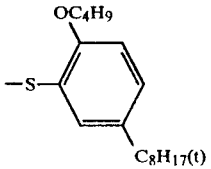 |

-continued
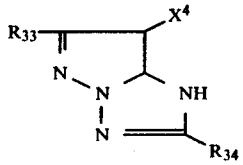
| Compound | $R_{33}$ | $R_{34}$ | $X^4$ |
|---|---|---|---|
| M-5 | $CH_3$— | 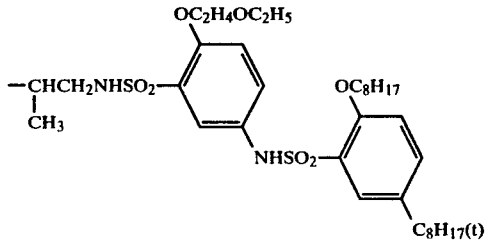 | Cl |
| M-6 | As above | 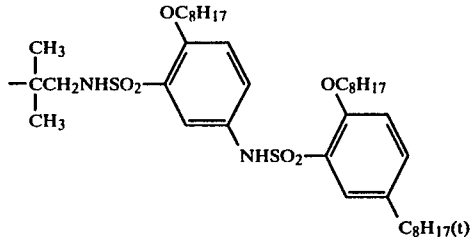 | As above |
| M-7 | 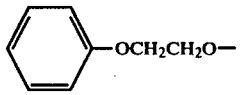 | 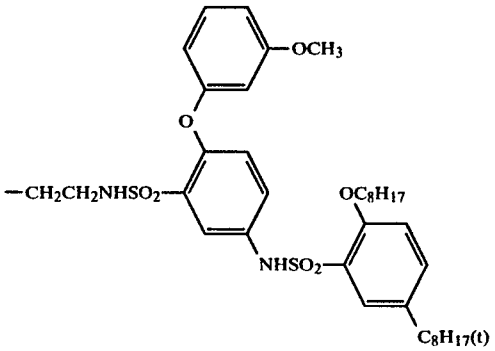 | 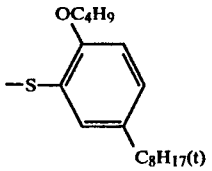 |

-continued
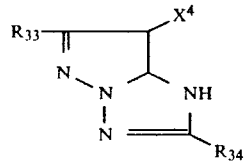
| Compound | $R_{33}$ | $R_{34}$ | $X^4$ |
|---|---|---|---|
| M-8 | $CH_3CH_2O$— | As above | As above |
| M-9 | 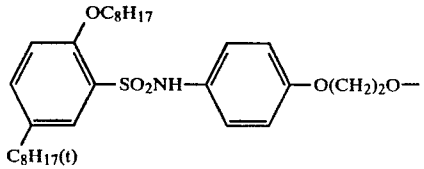 | 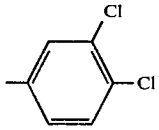 | As above |
| M-10 | 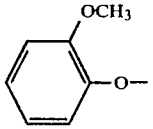 | 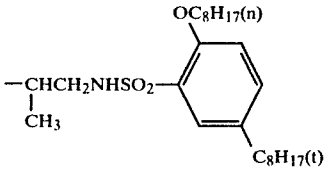 | Cl |
| M-11 | $CH_3$— | 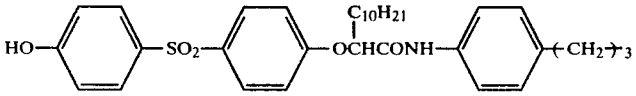 | Cl |
| M-12 | As above | 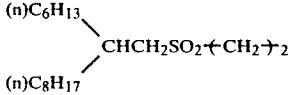 | As above |
| M-13 | 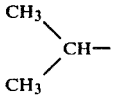 | 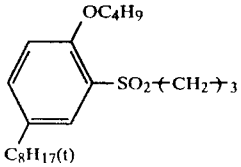 | As above |

-continued
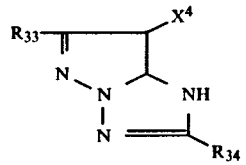
| Compound | $R_{33}$ | $R_{34}$ | $X^4$ |
|---|---|---|---|
| M-14 | $\leftarrow CH(COOCH_2CH_2OCH_3)-CH_2\rightarrow_{50}(CH_2-C(CH_3)(CONH-)\rightarrow_{50}$ | $CH_3-CH(CH_2NHSO_2CH_3)-$ | As above |
| M-15 | 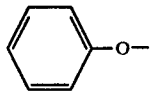 | 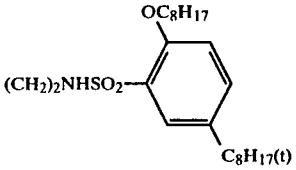 | Cl |
| M-16 | 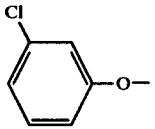 | 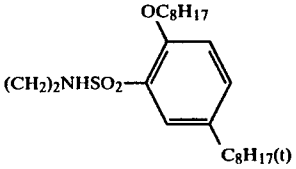 | 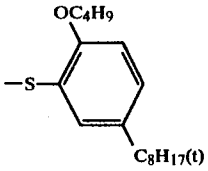 |

The most typical cyan couplers are the phenol based cyan couplers and the naphthol based cyan couplers.

There are phenol based cyan couplers which have an acylamino group in the 2-position and an alkyl group in the 5-position of the phenol ring (including polymerized couplers) as disclosed in U.S. Pat. Nos. 2,369,929, 4,518,687, 4,511,647, 3,772,002 etc., and typical examples include the coupler of Example 2 disclosed in Canadian Patent 625,822, compound (1) disclosed in U.S. Pat. No. 3,772,002, compounds (I-4) and (I-5) disclosed in U.S. Pat. No. 4,564,590, compounds (1), (2) and (3) disclosed in JP-A-61-39045, and the compound (C-2) disclosed in JP-A-62-70846.

There are the 2,5-diacylaminophenol based couplers disclosed in U.S. Pat. Nos. 2,772,162, 2,895,826, 4,334,011 and 4,500,653, and in JP-A-59-164555, and typical examples of these include compound (V) disclosed in U.S. Pat. No. 2,895,826, compound (17) disclosed in U.S. Pat. No. 4,557,999, compounds (2) and (12) disclosed in U.S. Pat. No. 4,565,777, compound (4) disclosed in U.S. Pat. No. 4,124,396, and compound (I-19) disclosed in U.S. Pat. No. 4,613,564, etc.

There are the phenol based cyan couplers in which a nitrogen containing heterocyclic ring is condensed with the phenol nucleus as disclosed in U.S. Pat. Nos. 4,327,173, 4,564,586 and 4,430,423, JP-A-61-390441, and JP-A-62-257158 and typical examples include the couplers (1) and (3) disclosed in U.S. Pat. No. 4,327,173, compounds (3) and (16) disclosed in U.S. Pat. No. 4,564,586, compounds (1) and (3) disclosed in U.S. Pat. No. 4,430,423, and the compounds shown below.

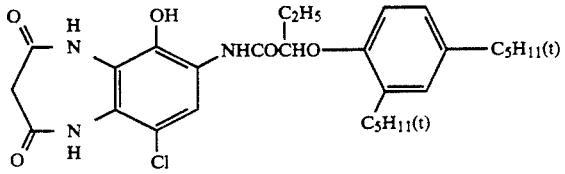

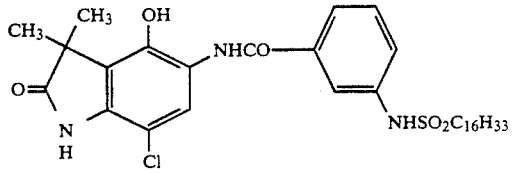

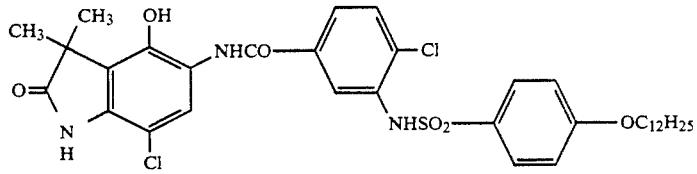

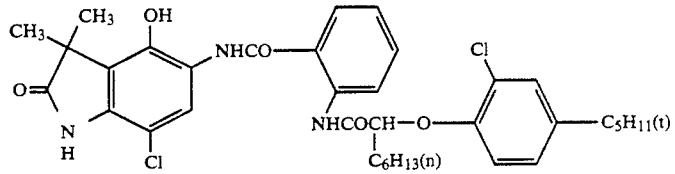

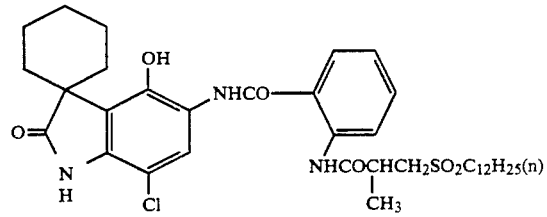

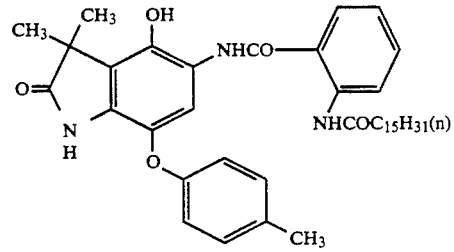

-continued

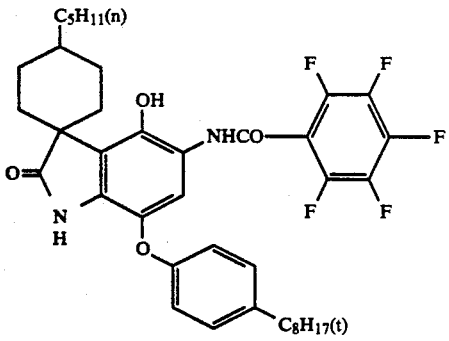

Other phenol based cyan couplers include the ureido based couplers disclosed in U.S. Pat. Nos. 4,333,999, 4,451,559, 4,444,872, 4,427,767 and 4,579,831 and in European Patent (EP) No. 067,689B1 etc., and typical examples include the coupler (7) disclosed in U.S. Pat. No. 4,333,999, the coupler (1) disclosed in U.S. Pat. No. 4,451,559, the coupler (14) disclosed in U.S. Pat. No. 4,444,872, the coupler (3) disclosed in U.S. Pat. No. 4,427,767, the couplers (6) and (24) disclosed in U.S. Pat. No. 4,609,619, the couplers (1) and (11) disclosed in U.S. Pat. No. 4,579,813, the couplers (45) and (50) disclosed in European Patent (EP) 67,689B1, and the coupler (3) disclosed in JP-A-61-42658, etc.

As naphthol based cyan couplers there are those which have an N-alkyl-N-arylcarbamoyl group in the 2-position of the naphthol nucleus (see, for example U.S. Pat. No. 2,313,586), those which have an alkylcarbamoyl group in the 2-position (see, for example U.S. Pat. Nos. 2,474,293 and 4,282,312), those which have an arylcarbamoyl group in the 2-position (see, for example JP-B-50-14523), those which have a carbonamido group or a sulfonamido group in the 5-position (see, for example JP-A-60-237448, JP-A-61-145557 and JP-A-61-153640), and those which have an aryloxy elimination group (see, for example U.S. Pat. No. 3,476,563), those which have a substituted alkoxy elimination group (see, for example U.S. Pat. No. 4,296,199) and those which have a glycolic acid elimination group (see, for example JP-B-60-39217), etc.

Hydroquinone derivatives, aminophenol derivatives, gallic acid derivatives, ascorbic acid derivatives etc. can also be included as anti-color fogging agents in photosensitive materials made using this invention.

The catechol derivatives disclosed for example in the specifications of JP-A-59-125732 and JP-A-60-262159 etc. can also be used as dye image stabilizers.

Ultraviolet absorbers may also be included in the hydrophilic colloid layers of photosensitive materials made using this invention. For example, it is possible to use benzotriazole compounds which are substituted with aryl groups (for example those disclosed in U.S. Pat. No. 3,533,794), 4-thiazolidone compounds (for example those disclosed in U.S. Pat. Nos. 3,314,794 and 3,352,681), benzophenone compounds (for example, those disclosed in JP-A-46-2784), ketoacid ester compounds (for example those disclosed in U.S. Pat. Nos. 3,705,805 and 3,707,375), butadiene compounds (for example those disclosed in U.S. Pat. No. 4,045,229) or benzo-oxydol compounds (for example those disclosed in U.S. Pat. No. 3,700,455). Couplers which have ultraviolet absorbing properties (for example the α-naphthol based cyan dye forming couplers) and polymers which have ultraviolet absorbing properties can also be used. These ultraviolet absorbers may be mordanted in a specified layer.

Water soluble dyes may be included in the hydrophilic colloid layers of photosensitive materials of this invention as filter dyes, with a view to preventing the occurrence of irradiation, or for other purposes.

Oxonol dyes, hemioxonol dyes, styryl dyes, merocyanine dyes, aniline dyes and azo dyes are included among these dyes. Of these dyes, the oxonol dyes, the hemioxonol dyes and merocyanine dyes are preferred.

Gelatin is useful as the binding agent or protective colloid which is used in the emulsion layers of photosensitive materials of this invention, but other hydrophilic colloids may be used either independently, or in conjunction with gelatin.

The gelatin used in the invention may be a lime treated gelatin or a gelatin which as been treated using an acid. Details of methods for the manufacture of gelatin have been disclosed in "The Macromolecular Chemistry of Gelatin", by Arthur Weiss, (published by Academic Press, 1964).

The cellulose nitrate films, cellulose acetate films, cellulose acetate butyrate films, cellulose acetate propionate films, polystyrene films, polyethyleneterephthalate films, polycarboante films and laminates of these materials, thin glass films, paper etc. normally used in photographic materials can be used for the support which is used in this invention. Good results are obtained with supports such as paper which has been coated or laminated with baryta or an α-olefin polymer, especially polymers based on α-olefins which have from 2 to 10 carbon atoms, such as polyethylene, polypropylene, ethylene butene copolymers etc., vinyl chloride resins which contain a reflecting substance such as $TiO_2$, and plastic films of which the adhesivity with other polymeric substances has been improved by roughening the surface in the way indicated in JP-B-47-19068. Furthermore, ultraviolet hardenable resins can also be used.

A transparent support or a non-transparent support is selected in accordance with the intended purpose of the photographic material. Furthermore, the support may be rendered colored and transparent by the addition of dyes or pigments.

As well as truly non-transparent materials such as paper, supports obtained by adding dyes or pigments such as titanium oxide to transparent films and plastic films which have been surface treated using the method disclosed in JP-B-47-19068, and paper are included among the non-transparent supports. An undercoating layer is normally established on the support. Preliminary treatments such as a coronal discharge treatment, ultraviolet irradiation treatment, flaming treatment etc.

can also be applied to the support surface in order to improve adhesivity.

The normal color photosensitive materials, especially color photographic materials for prints, can be used for making color photographs of this invention.

A black and white development bath and/or a color development bath can be used for the development of the photosensitive materials of this invention. The color development bath used is preferably an aqueous alkaline solution which contains a primary aromatic amine based color developing agent as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-N-8-methoxyethylaniline and the sulfate, hydrochloride and ptoluenesulfonate salts of these compounds. Two or more of these compounds can be used in combination, depending on the intended purpose.

The color development baths generally contain pH buffers such as the carbonates, borates or phosphates of the alkali metals, and development inhibitors or antifogging agents such as bromides, iodides, benzimidazoles, benzothiazoles or mercapto compounds etc. They may also contain, as required, various preservatives, such as hydroxylamine, diethylhydroxylamine, sulfite, hydrazines, phenylsemicarbazides, triethanolamine, catechol sulfonic acids, triethylenediamine(1,4-diazabicyclo[2,2,-2]octane), organic solvents such as ethylene glycol and diethylene glycol, development accelerators such as benzyl alcohol, poly(ethylene glycol), quaternary ammonium salts and amines, color forming couplers, competitive couplers fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, typical examples of which include ethylenediamine tetra-acetic acid, nitrilotriacetic acid, diethylenetriamine pentaacetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds.

Color development is carried out after a normal black and white development in the case of reversal processing. The known black and white developing agents, for example the dihydroxybenzenes such as hydroquinone etc., the 3-pyrazolidones such as 1-phenyl-3pyrazolidone etc., and the amino phenols such as N-methyl-p-aminophenol etc., can be used individually or in combination in the black and white development bath.

The pH of these color developing baths and black and white developing baths is generally within the range from 9 to 12. Furthermore, the replenishment rate of the development bath depends on the color photographic material which is being processed, but it is generally less than 3 liters per square meter of photosensitive material and it is possible, by reducing the bromide ion concentration in the replenisher, to use a replenishment rate of less than 500 ml per square meter of photosensitive material. The prevention of loss of liquid by evaporation, and aerial oxidation, by minimizing the contact area with air in the processing tank is desirable in cases where the replenishment rate is low. Furthermore, the replenishment rate can be reduced by using a means of suppressing the accumulation of bromide ion in the developer.

The photographic emulsion layers are subjected to a normal bleaching process after color development. The bleaching process may be carried out at the same time as the fixing process (in a bleach-fix process) or it may be carried out as a separate process. Moreover, a bleach-fix process can be carried out after a bleach process in order to speed up processing. Moreover processing can be carried out in two connected bleach-fix baths, a fixing process can be carried out before carrying out a bleach-fix process, or a bleaching process can be carried out after a bleach-fix process, according to the intended purpose of the processing. Compounds of a multi-valent metal such as iron(III), cobalt(III), chromium(VI), copper(II), etc., peracids, quinones, nitro compounds etc. can be used as bleaching agents. Typical bleaching agents include ferricyanides; dichromates; organic complex salts of iron(III) or cobalt(III), for example complex salts with aminopolycarboxylic acids such as ethylenediamine tetraacetic acid, diethylenetriamine pentaacetic acid, cyclohexanediamine tetra-acetic acid, methylimino diacetic acid, 1,3-diaminopropane tetra-acetic acid, glycol ether diamine tetra-acetic acid etc. or citric acid, tartaric acid, malic acid etc.; persulfates; bromates; permanganates and nitrobenzenes, etc. Of these materials the use of the aminopolycarboxylic acid iron(III) complex salts, principally ethylenediamine tetra-acetic acid iron(III) complex salts, and persulfates is preferred from the points of view of both rapid processing and the prevention of environmental pollution. Moreover, the amino polycarboxylic acid iron(III) complex salts are especially useful in both bleach baths and bleach-fix baths. The pH of bleach or bleach-fix baths in which aminopolycarboxylic acid iron(III) complex salts are being used is normally from 5.5 to 8, but processing can be carried out at lower pH values in order to speed up processing.

Bleach accelerators can be used, as required, in the bleach baths, bleach-fix baths, or bleach or bleach-fix prebaths. Actual examples of useful bleach accelerators have been disclosed in the following specifications: Thus there are the compounds which have a mercapto group or a disulfide group disclosed in U.S. Pat. No. 3,893,858, West German Patents 1,290,812, and 2,059,988, JP-A-53-32736, JP-A-53-57831, JP-A 53-37418, JP-A-53-72623, JP-A-53-95630, JP-A-53-95631, JP-A-53-04232, JP-A-53-124424, JP-A-53-141623 and JP-A-53-28426, and in *Research Disclosure* No. 17,129 (July 1978) etc.; the thiazolidine derivatives disclosed in JP-A-50-40129; the thiourea derivatives disclosed in JP-B-45-8506, JP-A-52-20832 and JP-A-53-32735, and in U.S. Pat. No. 3,706,561; the iodides disclosed in West German Patent 1,127,715 and in JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ions etc. Among these compounds, those which have a mercapto group or a disulfide group are preferred in view of their large accelerating effect, and the use of the compounds disclosed in U.S. Pat. No. 3,893,858, West German Patent 1,290,812 and JP-A-53-95630 is specially desirable. Moreover, the use of the compounds disclosed in U.S. Pat. No. 4,552,834 is also desirable. These bleach accelerators may be added to the sensitive material. These bleach accelerators are especially effective with bleach-fixing color photosensitive materials for photographic purposes.

Thiosulfates, thiocyanates, thioether based compounds, thioureas and large quantities of iodides etc. can be used as fixing agents, but thiosulfates are generally used for this purpose, and ammonium thiosulfate in particular can be used in the widest range of applications. Sulfites or bisulfites, or carbonyl-bi-sulfite addition compounds, are the preferred preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example the materials, such as the couplers, which are being used), the wash water temperature, the number of washing tanks (the number of washing stages), the replenishment system, i.e. where a counter-flow or a sequential-flow system is used, and various other conditions. The relationship between the amount of water used and the number of water washing tanks in a multi-stage counter-flow system can be obtained using the method outlined on pages 248 to 253 of Journal of the Society of Motion Picture and Television Engineers, Volume 64 (May 1955).

The amount of wash water can be greatly reduced by using the multi-stage counter-flow system noted in the aforementioned literature, but bacteria proliferate due to the increased residence time of the water in the tanks and problems arise as a result of the sediments which are formed becoming attached to the photosensitive material. The method in which the calcium ion and manganese ion concentrations are reduced as disclosed in JP-A-62-288838 can be used very effectively to overcome problems of this sort in the processing of color photosensitive materials of this invention. Furthermore, the isothiazolone compounds and thiabendazoles disclosed in JP-A-57-8542, and the chlorine based disinfectants such as chlorinated sodium isocyanurate, and benzotriazoles etc., and the disinfectants disclosed in "Chemistry of Biocides and Fungicides" by Horiguchi, "Reduction of Micro-organisms, Biocidal and Fungicidal Techniques", published by the Health and Hygiene technical Society and in "A Dictionary of Biocides and Fungicides", published by the Japanese Biocide and Fungicide Society, can be used for this purpose.

The pH value of the wash water used in the processing of the photosensitive materials of the invention is within the range of from 4 to 9, and preferably within the range of from 5 to 8. The wash water temperature and the washing time can be set according to the nature of the photosensitive material and the application etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, there are cases in which a stabilization process is carried out following the aforementioned water washing process and the stabilizing baths which contain formalin and surfactant which are used as a final bath for color photosensitive materials used for photographic purposes are an example of such a process. Various chelating agents and fungicides etc. can be added to these stabilizing baths.

The overflow which accompanies replenishment of the above mentioned wash water and/or stabilizer can be reused in other processes such as the desilvering process etc.

A color developing agent may also be incorporated into the silver halide color photosensitive materials of this invention in order to simplify and speed-up processing. The use of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure* Nos. 14,850 and 15,159 the aldol compounds disclosed in *Research Disclosure* No. 13,924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed in JP-A-56-64339, JP-A-57-44547 and JP-A-58-115438 etc.

The various processing baths are used at a temperature of from 10° to 50° C. in this invention. The standard temperature is normally from 33° to 38° C., but processing is accelerated and the processing time is shortened at higher temperatures and, conversely, higher picture quality and improved stability of the processing baths can be achieved at lower temperatures. Furthermore, processes using hydrogen peroxide intensification or cobalt intensification as disclosed in West German Patent 2,226,770 or U.S. Pat. No. 3,674,499 can be carried out in order to economize on silver in the photosensitive material.

In order to realize to the full extent the distinguishing features of the silver halide photographic materials of this invention, the silver halide color photographic material which has, on a reflective support, at least one photosensitive layer which contains silver halide grains of this invention and at least one type of coupler which forms a dye by means of a coupling reaction with the oxidized form of a primary aromatic amine developing agent is preferably processed for a development time of not more than 2 minutes 30 seconds in a color development bath which is essentially free of benzyl alcohol and which contains not more than 0.002 mol/liter of bromide ion.

The term "essentially free of benzyl alcohol" as used above signifies a concentration of benzyl alcohol not exceeding 2 ml per liter of color development bath, preferably not exceeding 0.5 ml per liter of development bath or, most desirably, the complete absence of benzyl alcohol.

The present invention will now be described by reference to non-limiting examples, unless otherwise specified, all percents, ratios, parts, etc., are by weight.

EXAMPLE 1

Lime treated gelatin (32 grams) was added to 1000 ml of distilled water and, after forming a solution at 40° C, 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes while maintaining the temperature at 52° C. Moreover, a solution obtained by dissolving 128.0 grams of silver nitrate in 560 ml of distilled water and a solution obtained by dissolving 44.0 grams of sodium chloride in 560 ml of distilled water were added to, and mixed with, the above mentioned mixture over a period of 20 minutes while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl]-3-benzooxazolio]ethane sulfonic acid, pyridinium salt, was added 1 minute after the addition of the aqueous silver nitrate solution and the aqueous sodium chloride solution had been completed. The temperature was then maintained at 52° C. for a period of 15 minutes, after which it was reduced to 40° C. and the mixture was desalted and washed with water. Then a further 90.0 grams of lime treated gelatin was added and, after adjusting to pAg 7.2 using sodium chloride, 2.0 mg of triethylthiourea was added and chemical sensitization was carried out optimally at 58° C. The silver chloride emulsion so obtained was referred to as emulsion A-1.

An emulsion was prepared in the same way as emulsion A-1 except that 0.046 mg of potassium hexachloroiridate (IV) was added to the aqueous sodium chloride solution which was added on the second occasion, and this was referred to as emulsion A-2.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 0.27 gram of potassium bromide and 10.9 gram chloride in 200 ml of distilled water were added to, and mixed with, the aforementioned solution over a period of 14 minutes while maintaining the temperature at 52° C. Moreover, a solution obtained by dissolving 128.0 grams of silver nitrate in 560 ml of distilled water and a solution obtained by dissolving 1.08 grams of potassium bromide and 43.5 grams of sodium chloride in 560 ml of distilled water were added to, and mixed with, the above mentioned mixture over a period of 20 minutes while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl}-3-benzooxazolio]ethane sulfonic acid, pyridinium salt, was added 1 minute after the addition of the aqueous silver nitrate solution and the aqueous alkali halide solution had been completed. The temperature was then maintained at 52° C. for a period of 15 minutes, after which it was reduced to 40° C. and the mixture was desalted and washed with water. Then a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (1.2 mol% silver bromide) emulsion so obtained was referred to as emulsion B-1.

An emulsion was prepared in the same way as emulsion B-1 except that 0.046 mg of potassium hexachloroiridate (IV) was added to the aqueous alkali halide solution which was added on the second occasion, and this was referred to as emulsion B-2.

Next 32 grams of lime treated gelatin was added to 1000 ml of distilled water and, after forming a solution at 40° C., 3.3 grams of sodium chloride was added and the temperature was raised to 52° C. A 1% aqueous solution of N,N' dimethylimidazolidin-2-thione (3.2 ml) was added to this solution. Next, a solution obtained by dissolving 29.6 grams of silver nitrate in 200 ml of distilled water and a solution obtained by dissolving 8.0 grams of sodium chloride in 146 ml of distilled water were added to, and mixed with, the aforementioned solution while maintaining the temperature at 52° C., the addition of the two solutions starting at the same time, with the addition of the aqueous silver nitrate solution taking place over a period of 12 minutes 57 seconds and the addition of the aqueous sodium chloride solution taking place over a period of 10 minutes 11 seconds. Moreover, a solution obtained by dissolving 2.4 grams of silver nitrate in 20 ml of distilled water and a solution obtained by dissolving 1.35 grams of potassium bromide and 0.17 gram of sodium chloride in 20 ml of distilled water were added to, and mixed with, the above mentioned mixture over a period of 5 minutes while maintaining the temperature at 52° C. Then a solution obtained by dissolving 128.0 grams of silver nitrate in 560 ml of distilled water and a solution obtained by dissolving 44.0 grams of sodium chloride in 560 ml of distilled water were added to, and mixed with, the aforementioned mixture over a period of 20 minutes while maintaining the temperature at 52° C. Next 286.7 mg of 2-[5-phenyl-2-{2-[5-phenyl-3-(2-sulfonatoethyl)benzooxazolin-2-yidenemethyl]-1-butenyl}-3-benzooxazolio]ethane sulfonic acid, pyridinium salt, was added 1 minute after the addition of the aqueous silver nitrate solution and the aqueous sodium chloride solution had been completed. The temperature was then maintained at 52° C. for a period of 15 minutes, after which it was reduced to 40° C. and the mixture was desalted and washed with water. Then a further 90.0 grams of lime treated gelatin was added and, after adjusting to pAg 7.2 using sodium chloride, 2.0 mg of triethylthiourea as added and chemical sensitization was carried out optimally at 58° C. The silver chlorobromide (1.2 mol% silver bromide) emulsion so obtained was referred to as emulsion C-1.

An emulsion was prepared in the same way as emulsion C-1 except that 0.046 mg of potassium hexachloroiridate (IV) was added to the aqueous sodium chloride solution which was added on the third occasion, and this was referred to as emulsion C-2.

Furthermore, an emulsion was prepared in the same way as emulsion C-1 except that 0.91 mg of potassium hexachloroiridate (IV) was added to the aqueous alkali halide solution which was added on the second occasion, and this was referred to as emulsion C-3.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml)

was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes, while maintaining the temperature at 52° C. Moreover, a solution obtained by dissolving 125.6 grams of silver nitrate in 560 ml of distilled water and a solution obtained by dissolving 41.0 grams of sodium chloride in 532 ml of distilled water were added to, and mixed with, the above mentioned mixture while maintaining the temperature at 52° C., the addition of the two solutions being started at the same time, with the addition of the silver nitrate solution taking place over a period of 19 minutes 38 seconds and the addition of the aqueous sodium chloride solution taking place over a period of 18 minutes 38 seconds. Then a solution obtained by dissolving 2.4 gram of silver nitrate in 20 ml of distilled water and a solution obtained by dissolving 1.35 grams of potassium bromide and 0.17 gram of sodium chloride in 20 ml of distilled water were added to, and mixed with, the aforementioned mixture over a period of 5 minutes while maintaining the temperature at 52° C. Next 286.7 mg of 2-[5-phenyl-2-{2-[5-phenyl-3-(2-sulfonatoethyl)benzooxazolin-2-yridenemethyl]-1-butenyl}-3-benzooxazolio]-ethane sulfonic acid, pyridinium salt, was added 1 minute after the addition of the aqueous silver nitrate solution and the aqueous alkali halide solution had been completed. The temperature was then maintained at 52° C. for a period of 15 minutes, after which it was reduced to 40° C. and the mixture was desalted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (1.2 mol% silver bromide) emulsion so obtained was referred to as emulsion D-1.

An emulsion was prepared in the same way as emulsion D-1 except that 0.046 mg of potassium hexachloroiridate (IV) was added to the aqueous sodium chloride solution which was added on the second occasion, and this was referred to as emulsion D-2.

Furthermore, an emulsion was prepared in the same way as emulsion D-1 except that 0.91 mg of potassium hexachloroiridate (IV) was added to the aqueous alkali halide solution which was added on the third occasion, and this was referred to as emulsion D-3.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes, while maintaining the temperature at 52° C. Moreover, a solution obtained by dissolving 125.6 grams of silver nitrate in 560 ml of distilled water and a solution obtained by dissolving 41.0 gram of sodium chloride in 560 ml of distilled water were added to, and mixed with, the above mentioned mixture while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl}-3-benzo-oxazolio]ethane sulfonic acid, pyridinium salt, was added 1 minute after the addition of the aqueous silver nitrate solution and the aqueous sodium chloride solution had been completed. Then a solution obtained by dissolving 2.4 grams of silver nitrate in 20 ml of distilled water and a solution obtained by dissolving 1.35 grams of potassium bromide and 0.17 gram of sodium chloride in 20 ml of distilled water were added to and mixed with the aforementioned mixture over a period of 5 minutes while maintaining the temperature at 52° C. Subsequently, the temperature was reduced to 40° C. and the mixture was desalted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (1.2 mol% silver bromide) emulsion so obtained was referred to as emulsion E-1.

An emulsion was prepared in the same way as emulsion E-1 except that 0.046 mg of potassium hexachloroiridate (IV) was added to the aqueous sodium chloride solution which was added on the second occasion, and this was referred to as emulsion E-2.

Furthermore, an emulsion was prepared in the same way as emulsion E-1 except that 0.91 mg of potassium hexachloroiridate (IV) was added to the aqueous alkali halide solution which was added on the third occasion, and this was referred to as emulsion E-3.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 1.12 grams of potassium bromide and 10.4 grams of sodium chloride in 200 ml of distilled water were added to, and mixed with, the aforementioned solution over a period of 14 minutes 50 seconds, while maintaining the temperature at 52° C. Moreover, a solution obtained by dissolving 128.0 grams of silver nitrate in 560 ml of distilled water and a solution obtained by dissolving 4.48 grams of potassium bromide and 41.8 grams of sodium chloride in 560 ml of distilled water were added to, and mixed with, the above mentioned mixture while maintaining the temperature at 52° C. Next 286.7 mg of 2-[5-phenyl-2-{2-[5-phenyl-3-(2-sulfonatoethyl)benzooxazolin-2-ylidene-methyl]-1-butenyl}-3-benzooxazolio]ethane sulfonic acid, pyridinium salt, was added 1 minute after the addition of the aqueous silver nitrate solution and the aqueous sodium chloride solution had been completed. The temperature was then maintained at 52° C. for a period of 15 minutes, after which it was reduced to 40° C. and the mixture was desalted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (5.0 mol% silver bromide) emulsion so obtained was referred to as emulsion F-1.

An emulsion was prepared in the same way as emulsion F-1 except that 0.046 mg of potassium hexachloroiridate (IV) was added to the aqueous sodium chloride solution which was added on the second occasion, and this was referred to as emulsion F-2.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes, while maintaining the temperature at 52° C. Moreover, a solution obtained by dissolving 118.0 grams of silver nitrate in 520 ml of distilled water and a solution obtained by dissolving 38.4 gram of sodium chloride in 492 ml of distilled water were added to, and mixed with, the above mentioned mixture while maintaining the temperature at 52° C., the addition of the two solutions being started at the same time with the aqueous silver nitrate solution being added over a period of 18 minutes 26 seconds and the aqueous sodium chloride solution being added over a period of 17 minutes 26 seconds. Then a solution obtained by dissolving 10.0 grams of silver nitrate in 60 ml of distilled water and a solution obtained by dissolving 5.6 grams of potassium bromide and 0.69 gram of sodium chloride in 60 ml of distilled water were added to, and mixed with, the aforementioned mixture over a period of 20 minutes while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl}-3-benzooxazolio]ethane sulfonic acid, pyridinium salt, was added 1 minute after the addition of the aqueous silver nitrate solution and the aqueous alkali halide solution had been completed. The temperature was maintained at 52° C. for 15 minutes, after which it was reduced to 40° C. and the mixture was desalted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (5.0 mol% silver bromide) emulsion so obtained was referred to as emulsion G-1.

An emulsion was prepared in the same way as emulsion G-1 except that 0.046 mg of potassium hexachloroiridate (IV) was added to the aqueous sodium chloride solution which was added on the second occasion, and this was referred to as emulsion G-2.

Furthermore, an emulsion was prepared in the same way as emulsion G-1 except that 0.91 mg of potassium hexachloroiridate (IV) was added to the aqueous alkali halide solution which was added on the third occasion, and this was referred to as emulsion G-3.

Next, 32 grams of lime treated gelatin was added to 1000 ml of distilled water and, after forming a solution at 40° C., 3.3 grams of sodium, chloride was added and the temperature was raised to 52° C. A 1% aqueous solution of N,N'-dimethylimidazolin-2-thione (3.2 ml) was added to this solution. Next, a solution obtained by dissolving 32.0 grams of silver nitrate in 200 ml of distilled water and a solution obtained by dissolving 4.48 grams of potassium bromide and 8.81 grams of sodium chloride in 200 ml of distilled water were added to, and mixed with, the aforementioned solution over a period of 17 minutes 30 seconds while maintaining the temperature at 52° C. Moreover, a solution obtained by dissolving 128.0 grams of silver nitrate in 560 ml of distilled water and a solution obtained by dissolving 17.9 grams of potassium bromide and 35.2 grams of sodium chloride in 650 ml of distilled water were added to, and mixed with, the above mentioned mixture over a period of 20 minutes while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl}-3-benzooxazolio]ethane sulfonic acid, pyridinium salt, was added 1 minute after the addition of the aqueous silver nitrate solution and the aqueous alkali halide solution had been completed. The temperature was maintained at 52° C. for 15 minutes, after which it was reduced to 40° C. and the mixture was de-salted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chlorobromide (20.0 mol% silver bromide) emulsion so obtained was referred to as emulsion H-1.

An emulsion was prepared in the same way as emulsion H-1 except that 0.046 mg of potassium hexachloroiridate (IV) was added to the aqueous sodium chloride solution which was added on the second occasion, and this was referred to as emulsion H-2.

Next, 32 grams of lime treated gelatin was added to 1000 ml of distilled water and, after forming a solution at 40° C., 3.3 grams of sodium chloride was added and the temperature was raised to 52° C. A 1% aqueous solution of N,N'-dimethylimidazolidin-2-thione (3.2 ml) was added to this solution. Next, a solution obtained by dissolving 32.0 grams of silver nitrate in 200 ml of distilled water and a solution obtained by dissolving 11.0 grams of sodium chloride in 200 ml of distilled water were added to, and mixed with, the aforementioned solution over a period of 14 minutes, while maintaining the temperature at 52° C. Moreover, a solution obtained by dissolving 88.0 grams of silver nitrate in 385 ml of distilled water and a solution obtained by dissolving 28.1 grams of sodium chloride in 357 ml of distilled water were added to, and mixed with, the above mentioned mixture while maintaining the temperature at 52° C., the addition of the two solutions being started at the same time with the aqueous silver nitrate solution being added over a period of 13 minutes 45 seconds and the aqueous sodium chloride solution being added over a period of 12 minutes 45 seconds. Then a solution obtained by dissolving 40.0 grams of silver nitrate in 60 ml of distilled water and a solution obtained by dissolving 22.4 grams of potassium bromide and 2.75 gram of sodium chloride in 175 ml of distilled water were added to, and mixed with, the aforementioned mixture over a period of 40 minutes while maintaining the temperature at 52° C. Next 286.7 mg of 2-[5-phenyl-2-{2-[5-phenyl-3-(2-sulfonatoethyl)benzooxazolin-2-ylidenemethyl]-1-butenyl}-3-benzooxazolio]ethane sulfonic acid, pyridinium salt, was added 1 minute after the addition of the aqueous silver nitrate solution and the aqueous alkali halide solution had been completed. The temperature was maintained at 52° C. for 15 minutes, after which it was reduced to 40° C. and the mixture was desalted and washed with water. Then, a further 90.0 grams of lime treated gelatin was added and, after adjusting to pAg 7.2 using sodium chloride, 2.0 mg of triethylthiourea was added and chemical sensitization was carried out optimally at 58° C. The silver chloride emulsion so obtained was referred to as emulsion I-1.

An emulsion was prepared in the same way as emulsion I-1 except that 0.046 mg of potassium hexachloroiridate (IV) was added to the aqueous sodium chloride solution which was added on the second occasion, and this was referred to as emulsion I-2.

Furthermore, an emulsion was prepared in the same way as emulsion I-1 except that 0.91 mg of potassium hexachloroiridate (IV) was added to the aqueous alkali halide solution which was added on the third occasion, and this was referred to as emulsion H-3.

The forms of the grains, the grain sizes and the grain size distributions of the twenty-three silver halide emulsions A-1 to I-3 prepared in this way were obtained from electron-micrographs. The silver halide grains in all of the emulsions from A-1 to I-3 were of a cubic form. The grain size was represented by the average value of the diameters of the circles corresponding to the projected areas of the grains, and the value obtained on dividing the standard deviation of the grain size by the average grain size was used as a measure of the grain size distribution. The results obtained were as shown in Table 1.

The halogen composition of the emulsion grains was then determined by measuring X-ray diffraction from the silver halide crystals. A monochromatic $Cu_{k\alpha}$ beam was used as the source and the diffraction angles of the diffraction lines from the (200) surface were measured in detail. Whereas the diffraction lines from a crystal which has a uniform halogen composition consist of a single peak, the diffraction lines from crystals which have local phases of different composition consist of a plurality of peaks corresponding to the compositions of the phases. The lattice constant can be calculated from the diffraction angle of the measured peaks and it is possible to determine the halogen composition of the silver halide from which the crystal is made. The results obtained were as shown in Table 2.

TABLE 1

| Emulsion | Form | Grain Size, μ, and (distribution) | |
|---|---|---|---|
| A-1 | Cubic | 0.51 | (0.08) |
| A-2 | " | 0.51 | (0.08) |
| B-1 | " | 0.50 | (0.09) |
| B-2 | " | 0.50 | (0.09) |
| C-1 | " | 0.51 | (0.08) |
| C-2 | " | 0.51 | (0.08) |

TABLE 1-continued

| Emulsion | Form | Grain Size, μ, and (distribution) | |
|---|---|---|---|
| C-3 | " | 0.51 | (0.08) |
| D-1 | " | 0.51 | (0.09) |
| D-2 | " | 0.51 | (0.09) |
| D-3 | " | 0.51 | (0.09) |
| E-1 | " | 0.51 | (0.08) |
| E-2 | " | 0.51 | (0.08) |
| E-3 | " | 0.51 | (0.08) |
| F-1 | " | 0.48 | (0.10) |
| F-2 | " | 0.48 | (0.10) |
| G-1 | " | 0.51 | (0.10) |
| G-2 | " | 0.51 | (0.10) |
| G-3 | " | 0.51 | (0.10) |
| H-1 | " | 0.50 | (0.10) |
| H-2 | " | 0.50 | (0.10) |
| I-1 | " | 0.51 | (0.11) |
| I-2 | " | 0.51 | (0.11) |
| I-3 | " | 0.51 | (0.11) |

TABLE 2

| Emulsion | Main Peak | Subsidiary Peak | Remarks: Local silver bromide phase | Remarks: Period at which the iridium was Introduced |
|---|---|---|---|---|
| A-1 | Cl 100% | — | No | — |
| A-2 | Cl 100% | — | No | When forming the 100% AgCl phase |
| B-1 | Cl 98.8% (Br 1.2%) | — | No | — |
| B-2 | Cl 98.8% (Br 1.2%) | — | No | When forming the 98.8% AgCl phase |
| C-1 | Cl 100% | Cl 76% to 90% | Yes | — |
| C-2 | Cl 100% | Cl 76% to 90% | Yes | When forming the 100% AgCl phase |
| C-3 | Cl 100% | Cl 76% to 90% | Yes | When forming the localized phase |
| D-1 | Cl 100% | Cl 68% to 90% | Yes | — |
| D-2 | Cl 100% | Cl 68% to 90% | Yes | When forming the 100% AgCl phase |
| D-3 | Cl 100% | Cl 68% to 90% | Yes | When forming the localized phase |
| E-1 | Cl 100% | Cl 61% to 90% | Yes | — |
| E-2 | Cl 100% | Cl 61% to 90% | Yes | When forming the 100% AgCl phase |
| E-3 | Cl 100% | Cl 61% to 90% | Yes | When forming the localized phase |
| F-1 | Cl 95.0% (Br 5.0%) | — | No | — |
| F-2 | Cl 95.0% (Br 5.0%) | — | No | When forming the 95.0% AgCl phase |
| G-1 | Cl 100% | Cl 49% to 85% | Yes | — |
| G-2 | Cl 100% | Cl 49% to 85% | Yes | When forming the 100% AgCl phase |
| G-3 | Cl 100% | Cl 49% to 85% | Yes | When forming the localized phase |
| H-1 | Cl 80.0% (Br 20%) | — | No | — |
| H-2 | Cl 80.0% (Br 20%) | — | No | When forming the 80.0% AgCl phase |
| I-1 | Cl 100% | Cl 33% to 80% | Yes | — |
| I-2 | Cl 100% | Cl 33% to 80% | Yes | When forming the 100% AgCl phase |
| I-3 | Cl 100% | Cl 33% to 80% | Yes | When forming the localized phase |

Next 30.0 ml of ethyl acetate and 38.5 ml of solvent (d) were added to 29.6 grams of the magenta coupler (a) and 5.9 grams and 11.8 grams of the colored image stabilizers (b) and (c) respectively, and a solution was obtained. This solution was emulsified and dispersed in 320 ml of a 10% aqueous gelatin solution which contained 20 ml of 10% sodium dodecylbenzenesulfonate.

The emulsified coupler dispersion and the emulsion, thus obtained, were mixed together and were father mixed in coating liquids to prepare coating compositions shown in Table 3. The coating composition was coated with the layer structure indicated in Table 3 onto paper supports which had been laminated on both sides with polyethylene to provide 23 types of photosensitive material. 1-Oxy-3,5-dichloro-s-triazine, sodium salt, was used as a gelatin hardening agent in each layer.

TABLE 3

| | | |
|---|---|---|
| Second Layer | (Protective layer) | |
| | Gelatin | 1.50 g/m$^2$ |
| First Layer | (Green sensitive layer) | |
| | Silver chloride (chlorobromide) emulsion (A-1 to I-3) | 0.36 g/m$^2$ |
| | Magenta coupler (a) | 0.32 g/m$^2$ |
| | Colored Image Stabilizer (b) | 0.06 g/m$^2$ |
| | (c) | 0.13 g/m$^2$ |

TABLE 3-continued

| | | |
|---|---|---|
| | Solvent (d) | 0.42 ml/m$^2$ |
| | Gelatin | 1.00 g/m$^2$ |
| Support | Laminated on Both Sides with Polyethylene $TiO_2$ and ultramarine were included in the polyethylene on the same side as the first layer. | |

(a) Magenta Coupler

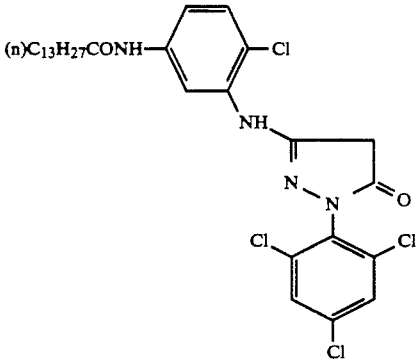

(b) Colored Image Stabilizer

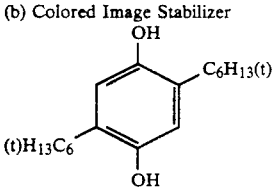

(c) Colored Image Stabilizer

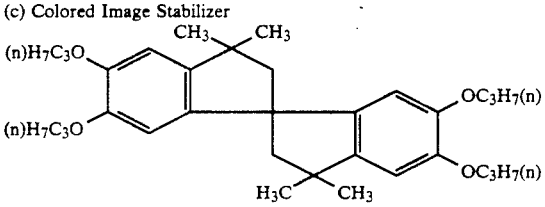

(d) Solvent

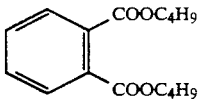

Furthermore, 125 mg of the compound indicated below was added per mol of silver halide to each coating liquid.

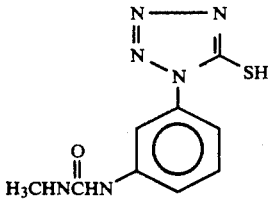

The properties of the emulsions prepared were tested using the 23 coated samples obtained in this way (these samples were identified using the designations assigned earlier for the emulsions).

Thus, the samples were exposed for 5 seconds through an optical wedge and a green filter and then, after 30 seconds, they were subjected to color development processing after using the processing operations and development bath indicated below. The luminance of the exposing device was then increased by a factor of 50 times, the samples were subjected to a 0.01 second exposure, and the exposed samples were processed after 30 seconds in the same way as before in order to investigate the changes which occurred when a short exposure was given at a high luminance. Furthermore, samples were processed in the same way as before except that times of 8 minutes or 60 minutes were allowed to elapse after exposure before carrying out development processing (the 0.5 seconds exposure conditions were used) in order to investigate the latent image stability of the emulsions.

| Processing Operation | Temperature | Time |
|---|---|---|
| Color development | 35° C. | 45 seconds |
| Bleach-fixing | 30 to 35° C. | 45 seconds |
| Rinse (1) | 30 to 35° C. | 20 seconds |
| Rinse (2) | 30 to 35° C. | 20 seconds |
| Rinse (3) | 30 to 35° C. | 20 seconds |
| Rinse (4) | 30 to 35° C. | 30 seconds |
| Drying | 70 to 80° C. | 60 seconds |

(Three tank counter-flow system from rinse (4) to rinse (1)).

The compositions of each of the processing baths were as indicated below.

| | |
|---|---|
| Color Development Bath | |
| Water | 800 ml |
| Ethylenediamine-N,N,N,N-tetra-methylenesulfonic acid | 1.5 grams |
| Triethylenediamine(1,4-diaza-bicyclo[2,2,2]octane) | 5.0 grams |
| Sodium sulfite | 1.4 grams |
| Potassium carbonate | 25 grams |
| N-Ethyl-N-(β-methanesulfonamidoethyl)-3-methyl-4-aminoaniline sulfate | 5.0 grams |
| N,N-Diethylhydroxylamine | 4.2 grams |
| Fluorescent whitener (UVITEX CK, Ciba Geigy Co.) | 2.0 grams |
| Water | to make up to 1000 ml |
| pH (25° C.) | 10.10 |
| Bleach-fix Bath | |
| Water | 400 ml |
| Ammonium thiosulfate (70%) | 100 ml |
| Sodium sulfite | 18 grams |
| Ethylenediamine tetra-acetic acid iron (III) ammonium salt | 55 grams |
| Ethylenediamine tetra-acetic acid di-sodium salt | 3 grams |
| Ammonium bromide | 40 grams |
| Glacial acetic acid | 8 grams |
| Water | to make up to 1000 ml |
| pH (25° C.) | 5.5 |
| Rinse Bath | |
| Ion exchanged water (Calcium and magnesium contents less than 3 ppm) | |

The reflection densities of each of the processed samples produced in this way were measured and the so-called characteristic curves were obtained. The reciprocal of the exposure which gave a density 0.5 higher than the fog density was taken as a measure of the speed, and the results were expressed as relative values taking the speed on exposing sample A-1 for 0.5 seconds and processing after 30 seconds to be 100. Furthermore, the difference between the density corresponding to an exposure increased 0.5 as log E from the exposure at which the speed was obtained and the density at the point where the speed was obtained was taken as a measure of contrast. Next, the fall in density on processing 30 seconds after a 0.01 second exposure at the exposure which gave a density of 2.2 on processing each sample 30 seconds after as 0.5 second exposure was obtained and this was taken as a measure of reciprocity failure with short exposure times at high luminance. Moreover, the densities on processing 8 minutes and 60 minutes after exposure on giving the exposure which gave a density of 1.5 when processed 30 seconds after a 0.5 second exposure were obtained for each sample. The results obtained in these tests were as shown in Table 4.

TABLE 4

| Sample | Performance on processing 30" after a 0.5" exposure Relative Speed | Contrast | High Luminance Reciprocity Law Failure* | Latent Image Stability*2 Processed after 30' to processed after 8' | Processed after 60' to processed after 8' | Remarks |
|---|---|---|---|---|---|---|
| A-1 | 100 | 1.45 | 0.96 | 0.03 | 0.04 | Comparative Example |
| A-2 | 71 | 1.39 | 0.30 | 0.35 | 0.52 | Comparative Example |
| B-1 | 112 | 1.41 | 0.90 | 0.02 | 0.04 | Comparative Example |
| B-2 | 85 | 1.35 | 0.28 | 0.30 | 0.48 | Comparative Example |
| C-1 | 195 | 1.29 | 0.75 | 0.04 | 0.05 | Comparative Example |
| C-2 | 148 | 1.23 | 0.21 | 0.34 | 0.46 | Comparative Example |
| C-3 | 174 | 1.33 | 0.05 | 0.02 | 0.02 | This Invention |
| D-1 | 200 | 1.38 | 0.68 | 0.03 | 0.03 | Comparative Example |
| D-2 | 151 | 1.30 | 0.18 | 0.35 | 0.50 | Comparative Example |
| D-3 | 173 | 1.42 | 0.07 | 0.02 | 0.03 | This Invention |
| E-1 | 224 | 1.41 | 0.61 | 0.04 | 0.06 | Comparative Example |
| E-2 | 166 | 1.33 | 0.16 | 0.38 | 0.52 | Comparative Example |
| E-3 | 199 | 1.49 | 0.04 | 0.00 | 0.01 | Thsi Invention |
| F-1 | 117 | 1.34 | 0.71 | 0.02 | 0.02 | Comparative Example |
| F-2 | 91 | 1.20 | 0.20 | 0.29 | 0.34 | Comparative Example |
| G-1 | 223 | 1.27 | 0.67 | 0.03 | 0.04 | Comparative Example |
| G-2 | 178 | 1.20 | 0.18 | 0.33 | 0.46 | Comparative Example |
| G-3 | 195 | 1.35 | 0.05 | 0.01 | 0.01 | This Invention |
| H-1 | 126 | 1.22 | 0.86 | 0.01 | 0.01 | Comparative Example |
| H-2 | 105 | 1.09 | 0.28 | 0.32 | 0.36 | Comparative Example |
| I-1 | 228 | 1.08 | 0.80 | 0.02 | 0.03 | Comparative Example |
| I-2 | 190 | 0.98 | 0.23 | 0.36 | 0.39 | Comparative Example |
| I-3 | 204 | 1.19 | 0.08 | 0.03 | 0.02 | This Invention |

*1, *2: In each case a smaller value is better.

It is clear from these results that high speeds can be obtained when there is a local phase of which the silver bromide content exceeds 20 mol%, but there is considerable reciprocity law failure and an adverse effect in cases where the exposure is made with a high speed printer etc. On the other hand, high luminance reciprocity is improved by doping with iridium, but the latent image stability is markedly worsened and it is difficult to apply this method in practice. However, it is possible to obtain emulsions which have a high speed and high contrast, with which there is no loss of latent image stability and which is superior in that the reciprocity law failure is improved by means of this invention.

EXAMPLE 2

Lime treated gelatin (32 grams) was added to 1000 ml of distilled water and, after forming a solution at 40° C., 5.8 grams of sodium chloride was added and the temperature was raised to 75° C. A 1% aqueous solution of N,N'-dimethylimidazolidin-2-thione (3.8 ml) was added to this solution. Next, a solution obtained by dissolving 6.4 grams of silver nitrate in 180 ml of distilled water and a solution obtained by dissolving 2.2 grams of sodium chloride in 180 ml of distilled water were added to, and mixed with, the aforementioned solution over a period of 10 minutes, while maintaining the temperature at 75° C. Moreover, a solution obtained by dissolving 153.6 grams of silver nitrate in 410 ml of distilled water and a solution obtained by dissolving 52.8 grams of sodium chloride in 410 ml of distilled water were added to, and mixed with, the above mentioned mixture over a period of 35 minutes while maintaining the temperature at 75° C. Next 172.8 mg of 3-{2-[5-chloro-3-(3-sulfonatoethyl)benzothiazolin-2ylidenemethyl]-3-naphtho[1,2-d]thiazolio.}propanesulfonic acid, triethylammonium salt, was added 1 minute after the addition of the aqueous silver nitrate solution and the aqueous sodium chloride solution had been completed. The temperature was maintained at 75° C. for 15 minutes, after which it was reduced to 40° C. and the mixture was de-salted and washed with water. Then, a further 90.0 grams of lime treated gelatin was added and, after adjusting to pAg 7.2 using sodium chloride, 1.0 mg of triethylthiourea was added and chemical sensitization was carried out optimally at 58° C. The silver chloride emulsion so obtained was referred to as emulsion J-1.

An emulsion was prepared in the same way as emulsion J-1 except that 0.021 mg of potassium hexachloroiridate (IV) was added to the aqueous sodium chloride solution which was added on the second occasion, and this was referred to as emulsion J-2.

Next, 32 grams of lime treated gelatin was added to 1000 ml of distilled water and, after forming a solution at 40° C., 5.8 grams of sodium chloride was added and the temperature was raised to 75° C. A 1% aqueous solution of N,N'-dimethylimidazolidin-2-thione (3.8 ml) was added to this solution. Next, a solution obtained by dissolving 6.4 grams of silver nitrate in 180 ml of distilled water and a solution obtained by dissolving 0.054 gram of potassium bromide and 2.18 grams of sodium chloride in 180 ml of distilled water were added to, and mixed with, the aforementioned solution over a period of 10 minutes while maintaining the temperature at 75° C. Moreover, a solution obtained by dissolving 153.6 grams of silver nitrate in 410 ml of distilled water and a solution obtained by dissolving 1.29 grams of potassium bromide and 52.21 grams of sodium chloride in 410 ml of distilled water were added to, and mixed with, the above mentioned mixture over a period of 35 minutes while maintaining the temperature at 75° C. Next 172.8 mg of 3-{2-[5-chloro-3-(3-sulfonatoethyl)benzothiazolin-2-ylidenemethyl]-1-butenyl}-3-naphtho[1,2-d]thiazolio}propanesulfonic acid, triethylammonium salt, was added 1 minute after the addition of the aqueous silver nitrate solution and the aqueous sodium chloride solution had been completed. The temperature was maintained at 75° C. for 15 minutes, after which it was reduced to 40° C. and the mixture was de-salted and washed with water. Then, a further 90.0 grams of lime treated gelatin was added and, after adjusting to pAg 7.2 using sodium chloride, 1.0 mg of triethylthiourea was added and chemical sensitization was carried out optimally at 58° C. The silver chloride emulsion so obtained was referred to as emulsion K-1.

An emulsion was prepared in the same way as emulsion K-1 except that 0.021 mg of potassium hexachloroiridate (IV) was added to the aqueous sodium chloride solution which was added on the second occasion, and this was referred to as emulsion K-2.

Next, 32 grams of lime treated gelatin was added to 1000 ml of distilled water and, after forming a solution at 40° C., 5.8 grams of sodium chloride was added and the temperature was raised to 75° C. A 1% aqueous solution of N,N'-dimethylimidazolidin-2-thione (3.8 ml) was added to this solution. Next, a solution obtained by dissolving 6.4 grams of silver nitrate in 180 ml of distilled water and a solution obtained by dissolving 2.2 grams of sodium chloride in 180 ml of distilled water were added to, and mixed with, the aforementioned solution over a period of 10 minutes, while maintaining the temperature at 75° C. Moreover, a solution obtained by dissolving 151.2 grams of silver nitrate in 410 ml of distilled water and a solution obtained by dissolving 47.4 grams of sodium chloride in 410 ml of distilled water were added to, and mixed with, the above mentioned mixture over a period of 35 minutes while maintaining the temperature at 75° C. Next 172.8 mg of 3-{2-[5-chloro-3-(3-sulfonatopropyl)-benzothiazolin-2-ylidenemethyl]-3-naphtho[1,2d]thiazolio]propanesulfonic acid, triethylammonium salt, was added 1 minute after the addition of the aqueous silver nitrate solution and the aqueous sodium chloride solution had been completed. The temperature was maintained at 75° C. for 15 minutes, after which it was reduced to 52° C. Subsequently, a solution obtained by dissolving 2.4 grams of silver nitrate in 20 ml of distilled water and a solution obtained by dissolving 1.35 grams of potassium bromide and 0.17 grams of sodium chloride in 20 ml of distilled water were added to, and mixed with, the aforementioned mixture over a period of 5 minutes while maintaining the temperature at 52° C. The temperature was then dropped to 40° C. and the mixture was de-salted and washed with water. Then, a further 90.0 grams of lime treated gelatin was added and, after adjusting to pAg 7.2 using sodium chloride, 1.0 mg of triethylthiourea was added and chemical sensitization was carried out optimally at 58° C. The silver chloride emulsion so obtained was referred to as emulsion L-1.

An emulsion was prepared in the same way as emulsion L-1 except that 0.240 mg of potassium hexachloroiridate (IV) was added to the aqueous sodium chloride solution which was added on the second occasion, and 0.160 mg of potassium pentachloroiridate (IV) was added to the aqueous alkali halide solution which was added on the third occasion, and this was referred to as emulsion L-2.

An emulsion was prepared in the same way as emulsion L-1 except that 0.400 mg of potassium hexachloroiridate (IV) was added to the aqueous alkali halide solution which was added on the third occasion, and this was referred to as emulsion L-3.

Next, an emulsion was prepared in the same way as emulsion E-2 in Example 1 except that 0.546 mg of potassium hexachloroiridate (IV) was added to the aqueous sodium chloride solution which was added on the second occasion, and 0.364 mg of potassium hexachloroiridate (IV) was added to the aqueous alkali halide solution which was added on the third occasion, and this was referred to as emulsion E-4.

Next emulsions M-1, M-2, N-1, N-2, O-1, O-3 and O-4 were prepared in the same way as emulsions A-1, A-2, B-1, B-2, E-1, E-3 and the above mentioned E-4 respectively except that 60.0 mg of 2-[2,4-(2,2-dimethyl-1,3-propano)-5-(6-methyl-3-pentylbenzothiazolin-2-ylidene)-1,3-pentadienyl]-3-ethyl-6-methylbenzothiazolium iodide was added in place of the 286.7 mg of 2-[5-phenyl-2-{2-[5-phenyl-3-(2-sulfonateoethyl)benzooxazolin-2-ylidenemethyl]-1-butenyl}-3-benzooxazolio]ethanesulfonic acid, pyridinium salt. The form of the grains, the grain sizes and the grain size distributions of the emulsions J-1, J-2, K-1, K-2, L-1, L-2 and L-3 prepared in this way were as shown in Table 5.

Furthermore, the halogen compositions of the emulsion grains were obtained using X-ray diffraction in the same way as in Example 1, and the results were as shown in Table 6.

TABLE 5

| Emulsion | Form | Grain Size, μ, and (distribution) | |
|---|---|---|---|
| J-1 | Cubic | 1.04 | (0.07) |
| J-2 | " | 1.04 | (0.07) |
| K-1 | " | 0.99 | (0.08) |
| K-2 | " | 0.99 | (0.08) |
| L-1 | " | 1.04 | (0.08) |
| L-2 | " | 1.04 | (0.08) |
| L-3 | " | 1.04 | (0.08) |

TABLE 6

| | | | Remarks | |
|---|---|---|---|---|
| Emulsion | Main Peak | Subsidiary Peak | Local silver bromide phase | Period at which the iridium was Introduced |
| J-1 | Cl 100% | — | No | — |
| J-2 | Cl 100% | — | No | When forming the 100% AgCl phase |
| K-1 | Cl 98.8% (Br 1.2%) | — | No | — |
| K-2 | Cl 98.8% (Br 1.2%) | — | No | When forming the 98.8% AgCl phase |
| L-1 | Cl 100% | Cl 58% to 90% | Yes | — |
| L-2 | Cl 100% | Cl 58% to 90% | Yes | When forming the 100% AgCl phase and the localized phase |
| L-3 | Cl 100% | Cl 58% to 90% | Yes | When forming the localized phase |
| E-4 | Cl 100% | Cl 58% to 90% | Yes | When forming the 100% AgCl phase and the localized phase |

Seven types of color photosensitive material were prepared by multi-layer coating using the emulsions obtained in this way in accordance with the composition and layer structure, and combinations of emulsions, shown in Tables 7 and 8.

PREPARATION OF THE FIRST LAYER COATING LIQUIDS

Ethyl acetate (27.2 ml) and 7.9 ml of solvent (d) were added to 19.1 grams of the yellow coupler (e) and 4.4 grams of the colored image stabilizer (f) to form a solution, and this solution was emulsified and dispersed in 10% aqueous gelatin solution which contained 8.0 ml of 10% sodium dodecylbenzenesulfonate.

On the other hand, the above mentioned emulsified dispersion was mixed with and dissolved in the silver chloride or silver chlorobromide emulsions shown in Table 8 to provide first layer coating liquids which had a composition as shown in Table 7.

The coating liquids for the second to the seventh layers were prepared using the same procedure as used for the first layer coating liquids. However, the emulsified dispersion used in the fifth layer coating liquids was used after the removal of the ethyl acetate under reduced pressure at 40° C. after emulsification and dispersion.

The same compound as used in Example 1 was used in each layer as a gelatin hardening agent.

The structural formulae of the couplers etc. used in this example are given below.

(e) Yellow Coupler

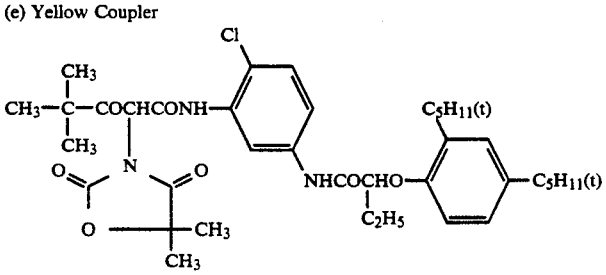

(f) Colored Image Stabilizer

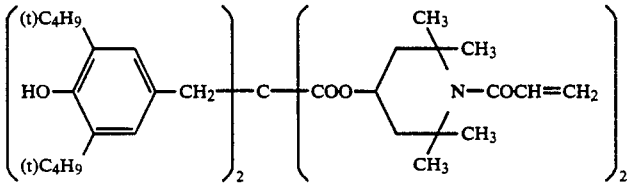

(g) Anti-Color Mixing Agent

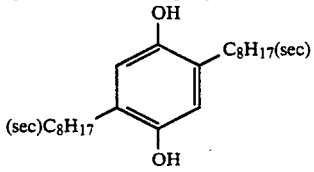

(h) Magenta Coupler

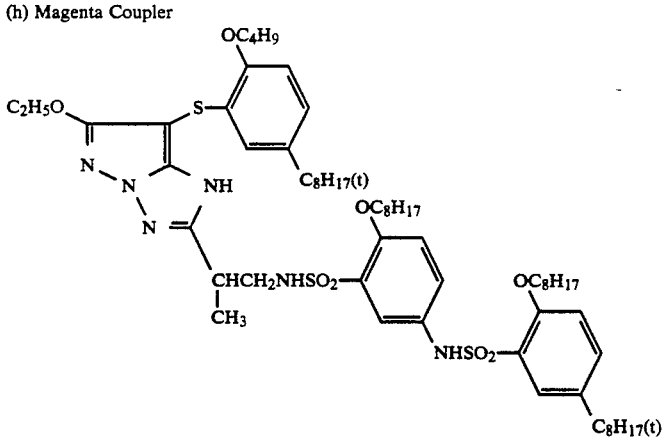

(i) Solvent

A 2:1 (by weight) mixture of:

$(C_8H_{17}O)_3-P=O$ and

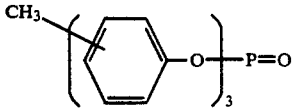

-continued
(j) Ultraviolet Absorber
A 1:5:3 (mol ratio) mixture of:
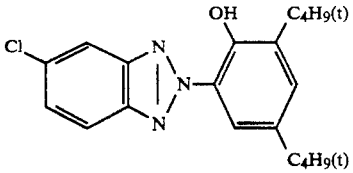
and
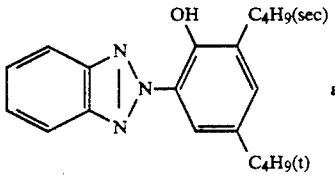
and
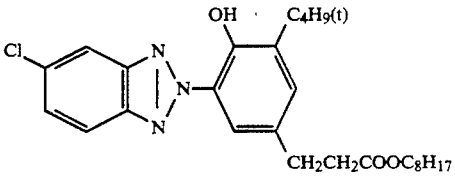
(k) Anti-color Mixing Agent
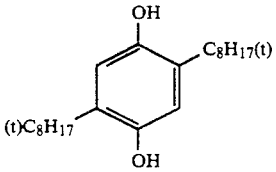
(l) Solvent
$(iso C_9H_{18}O)_3P{=}O$
(m) Cyan Coupler
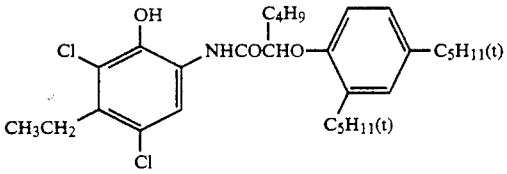
(n) Colored Image Stabilizer
A 1:3:3 (mol ratio) mixture of:
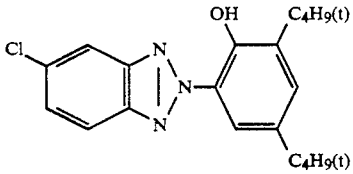
and
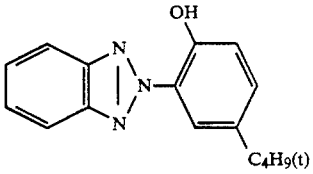
and
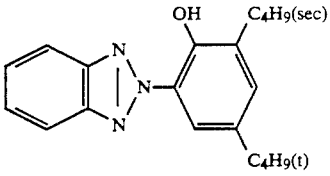
The following compounds were used in each layer as anti irradiation dyes.
In the Green Sensitive Emulsion Layer
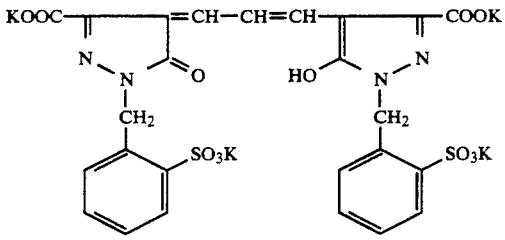
In the Red Sensitive Emulsion Layer -continued

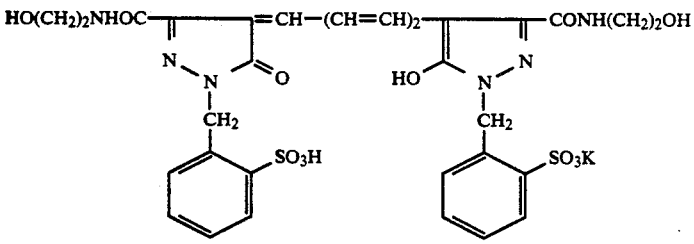

Furthermore, the compound shown below was added to each coating liquid, at the rate of 50 mg per mol of silver halide in the blue sensitive emulsion layer and at a rate of 125 mg per mol of silver halide in the green sensitive emulsion layer and the red sensitive emulsion layer.

TABLE 7

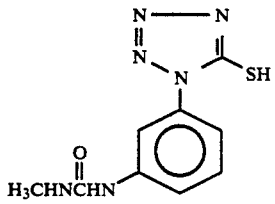

| Layer | Principal Composition | Amount Used |
|---|---|---|
| Seventh layer (Protective layer) | Gelatin | 1.33 grams/m$^2$ |
| | Acrylic modified poly-(vinyl alcohol) copolymer (17% modification) | 0.17 gram/m$^2$ |
| Sixth layer (Ultraviolet absorbing layer) | Gelatin | 0.54 gram/m$^2$ |
| | Ultraviolet absorber (j) | 0.21 gram/m$^2$ |
| | Solvent (l) | 0.09 ml/m$^2$ |
| Fifth layer (Red sensitive layer) | Silver halide emulsion (see Table 8) | 0.24 gram/m$^2$ |
| | Gelatin | 0.96 gram/m$^2$ |
| | Cyan coupler (m) | 0.38 gram/m$^2$ |
| | Colored image stabilizer (n) | 0.17 gram/m$^2$ |
| | Solvent (d) | 0.23 ml/m$^2$ |
| Fourth layer (Ultraviolet absorbing layer) | Gelatin | 1.60 grams/m$^2$ |
| | Ultraviolet absorber (j) | 0.62 gram/m$^2$ |
| | Anti-color mixing agent (k) | 0.05 gram/m$^2$ |
| | Solvent (l) | 0.26 ml/m$^2$ |
| Third layer (Green sensitive layer) | Silver halide emulsion (see Table 8) | 0.16 gram/m$^2$ |
| | Gelatin | 1.80 grams/m$^2$ |
| | Magenta coupler (h) | 0.45 gram/m$^2$ |
| | Colored image stabilizer (c) | 0.20 gram/m$^2$ |
| | Solvent (i) | 0.45 ml/m$^2$ |
| Second layer (Anti-color mixing layer | Gelatin | 0.99 gram/m$^2$ |
| | Anti-color mixing agent (g) | 0.08 gram/m$^2$ |
| First layer (Blue sensitive layer) | Silver halide emulsion (see Table 8) | 0.27 gram/m$^2$ |
| | Gelatin | 1.86 grams/m$^2$ |
| | Yellow coupler (e) | 0.74 gram/m$^2$ |
| | Colored image stabilizer (f) | 0.17 gram/m$^2$ |
| | Solvent (d) | 0.31 ml/m$^2$ |
| Support | Polyethylene laminated paper (TiO and ultramarine were included in the polyethylene positioned at the first layer side) | |

The amount of silver halide emulsion indicated is the amount calculated as silver.

TABLE 8

| Sample | Blue Sensitive Emulsion Layer | Green Sensitive Emulsion Layer | Red Sensitive Emulsion layer |
|---|---|---|---|
| a | J-1 | A-1 | M-1 |
| b | J-2 | A-2 | M-2 |
| c | K-1 | B-1 | N-1 |
| d | K-2 | B-2 | N-2 |
| e | L-1 | E-1 | O-1 |
| f | L-2 | E-4 | O-4 |
| g | L-3 | E-3 | O-3 |

Photographic performance was tested using the seven types of samples a to g obtained in this way.

Except that the samples were exposed using three types of filters, namely a blue filter, a green filter and a red filter, the samples were exposed and processed in the same way as in Example 1, and single layer colored samples of each photosensitive layer were prepared. The reflection densities of these samples were measured and the relative speed immediately after exposure, contrast, reciprocity law failure at high luminance and the latent image stability were investigated in each case in the same way as in Example 1. The results obtained are shown in Table 9.

Here, the speed of each photosensitive layer of sample a was taken to be 100 as the basis for the relative speeds of each of the layers in samples b to g (the blue sensitive layers were compared with the blue sensitive layer, the green sensitive layers with the green sensitive layer and the red sensitive layers with the red sensitive layer). Furthermore, the standard density for obtaining reciprocity failure at high luminance was 1.8 for the blue sensitive layer, 2.0 for the green sensitive layer and 2.2 for the red sensitive layer.

TABLE 9

| Sample *3 | Performance on processing 30" after a 0.5" exposure: Relative Speed | Contrast | High Luminance Reciprocity Law Failure*1 | Latent Image Stability*2: Processed after 30' to processed after 8' | Processed after 60' to processed after 8' | Remarks |
|---|---|---|---|---|---|---|
| a B | 100 | 1.25 | 0.73 | 0.02 | 0.04 | Comparative Example |
| G | 100 | 1.36 | 0.85 | 0.04 | 0.04 | |
| R | 100 | 1.47 | 0.98 | 0.03 | 0.04 | |

TABLE 9-continued

| Sample *3 | Performance on processing 30" after a 0.5" exposure Relative Speed | Contrast | High Luminance Reciprocity Law Failure*1 | Latent Image Stability*2 Processed after 30' to processed after 8' | Processed after 60' to processed after 8' | Remarks |
|---|---|---|---|---|---|---|
| b B | 75 | 1.21 | 0.24 | 0.18 | 0.36 | Comparative Example |
| G | 71 | 1.31 | 0.29 | 0.30 | 0.45 | |
| R | 69 | 1.41 | 0.34 | 0.36 | 0.54 | |
| c B | 118 | 1.20 | 0.73 | 0.04 | 0.05 | Comparative Example |
| G | 112 | 1.34 | 0.88 | 0.03 | 0.03 | |
| R | 110 | 1.43 | 0.93 | 0.02 | 0.04 | |
| d B | 88 | 1.20 | 0.18 | 0.17 | 0.29 | Comparative Example |
| G | 85 | 1.28 | 0.23 | 0.27 | 0.43 | |
| R | 85 | 1.36 | 0.27 | 0.33 | 0.47 | |
| e B | 218 | 1.24 | 0.50 | 0.03 | 0.07 | Comparative Example |
| G | 224 | 1.35 | 0.60 | 0.02 | 0.06 | |
| R | 210 | 1.44 | 0.69 | 0.03 | 0.07 | |
| f B | 178 | 1.28 | 0.02 | 0.31 | 0.39 | Comparative Example |
| G | 168 | 1.40 | 0.03 | 0.40 | 0.52 | |
| R | 170 | 1.48 | 0.03 | 0.36 | 0.50 | |
| g B | 195 | 1.28 | 0.03 | 0.02 | 0.02 | This Invention |
| G | 199 | 1.39 | 0.04 | 0.01 | 0.03 | |
| R | 210 | 1.50 | 0.05 | 0.01 | 0.02 | |

*1, *2: In each case a smaller value is better.
*3: B: Blue Sensitive Layer, G: Green Sensitive Layer, R: Red Sensitive Layer It is clear from these results that the invention is also very effective in multi-layer color photosensitive materials. Thus, on comparing samples a, c and e it is clear that higher speeds are achieved when a localized layer which has a silver bromide content of at least 20 mol% is present but that there is pronounced reciprocity law failure at high luminance and problems would be experienced in practice. Furthermore, on comparing sample b with sample a, sample d with sample c and sample f with sample e, it is clear that there is an improvement in respect to reciprocity law failure at high luminance on doping with iridium in each case but that there is a marked deterioration in latent image sensitization. On the other hand, with sample g, even though the emulsion has been doped with the same amount of iridium as sample e (in terms of the amounts per mol of silver halide), there is a considerable improvement in that there is virtually no latent image sensitization to be seen.

EXAMPLE 3

Tests were carried out in the same way using the coated samples a to g used in Example 2 except that the development processing operation and the processing baths were changed to those indicated below.

| Processing Operation | Temperature | Time |
|---|---|---|
| Color development | 35° C. | 45 seconds |
| Bleach-fixing | 30 to 36° C. | 45 seconds |
| Stabilizer (1) | 30 to 37° C. | 20 seconds |
| Stabilizer (2) | 30 to 37° C. | 20 seconds |
| Stabilizer (3) | 30 to 37° C. | 20 seconds |
| Stabilizer (4) | 30 to 37° C. | 30 seconds |
| Drying | 70 to 85° C. | 60 seconds |

(Four tank counter-flow system from stabilizer (4) to stabilizer (1)).

The composition of each processing bath was as indicated below.

| Color Development Bath | |
|---|---|
| Water | 800 ml |
| Ethylenediamine tetra-acetic acid | 2.0 grams |
| Triethanolamine | 8.0 grams |
| Sodium chloride | 1.4 grams |
| Potassium carbonate | 25.0 grams |
| N-Ethyl-N-(β-methanesulfonamidoethyl)-3-methyl-4-aminoaniline sulfate | 5.0 grams |

-continued

| | |
|---|---|
| N,N-Diethylhydroxylamine | 4.2 grams |
| 5,6-Dihydroxybenzene-1,2,4-trisulfonic acid | 0.3 gram |
| Fluorescent whitener (4,4'-diamino-stilbene based) | 2.0 grams |
| Water | to make up to 1000 ml |
| pH (25° C.) | 10.10 |
| Bleach-fix Bath | |
| Water | 400 ml |
| Ammonium thiosulfate (70%) | 100 ml |
| Sodium sulfite | 18 grams |
| Ethylenediamine tetra-acetic acid iron (III) ammonium salt | 55 grams |
| Ethylenediamine tetra-acetic acid di-sodium salt | 3 grams |
| Glacial acetic acid | 8 grams |
| Water | to make up to 1000 ml |
| pH (25° C.) | 5.5 |
| Stabilizer Bath | |
| Formalin (37%) | 0.1 gram |
| Formalin-bisulfite addition compound | 0.7 gram |
| 5-Cloro-2-methyl-4-isothiazolin-3-one-2-methyl-4-isothiazolin-3-one | 0.02 gram |
| 2-Methyl-4-isothiazolin-3-one | 0.01 gram |
| Copper sulfate | 0.005 gram |
| Water | to make up to 1000 ml |
| pH | 4.0 |

EXAMPLE 4

The 10 types of coated sample shown in Table 11 were prepared by substituting the compositions shown in Table 10 for the third and fifth layers of the multi-layer color photosensitive materials in Example 2.

The same tests as used in Example 2 were carried out and the effect of the invention was confirmed.

The results showed that in these coated samples the effect of using emulsions of this invention, namely a high contrast at high speed, little variation due to reciprocity law and excellent latent image stability, was pronounced.

(o) Magenta Coupler

-continued

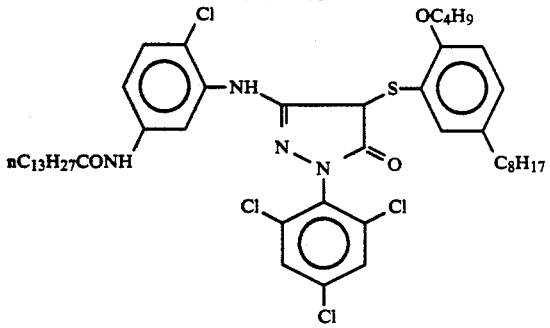

(p) Colored Image Stabilizer

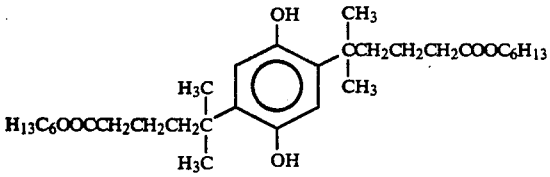

(q) A 2:2:1 (by volume) mixture of:

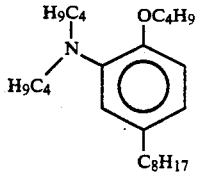

and

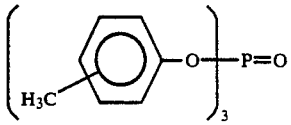

-continued and $(C_8H_{17}O)_3P{=}O$ (r) Cyan Coupler

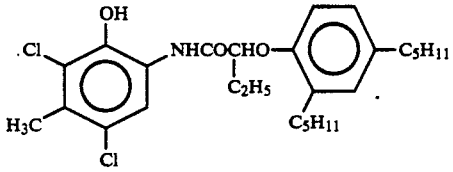

(s) Cyan Coupler

A 3:4 (by weight) mixture of:
The same Cyan Coupler as (r) and

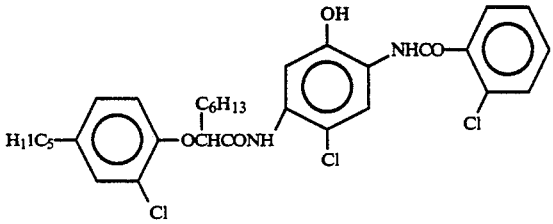

Compound (t)

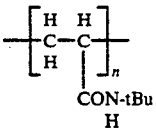

A polymer as indicated above of number average molecular weight 60,000.

(u) Magenta Coupler

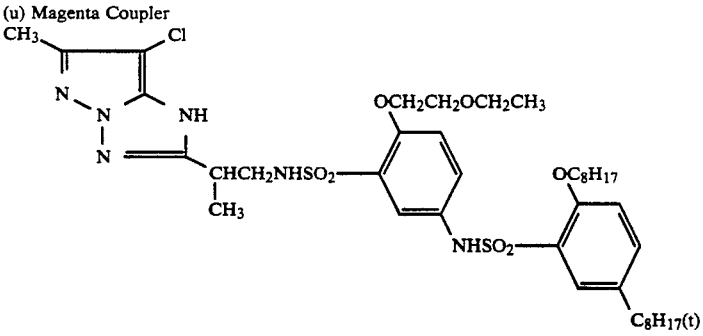

TABLE 10

| Layer | Principal Components | Amounts Coated | | | | |
|---|---|---|---|---|---|---|
| | | Samples h, i | Samples j, k | Samples l, m | Samples n, o | Samples p, q |
| Fifth Layer (Red Sensitive Layer) | Silver halide emulsion | 0.24 | 0.24 | 0.24 | 0.24 | 0.24 |
| | Gelatin | 0.96 | 0.96 | 0.96 | 1.60 | 1.60 |
| | Cyan coupler | (s) 0.37 | (s) 0.37 | (s) 0.37 | (r) 0.35 | (r) 0.35 |
| | Colored image stabilizer | (n) 0.17 | (n) 0.17 | (n) 0.17 | (n) 0.17 | (n) 0.17 |
| | Compound (t) | — | — | — | 0.35 | 0.35 |
| | Solvent | (d) 0.23 | (d) 0.23 | (d) 0.23 | (d) 0.23 | (d) 0.23 |
| Third Layer (Green Sensitive Layer) | Silver halide emulsion | 0.36 | 0.20 | 0.16 | 0.36 | 0.16 |
| | Gelatin | 1.20 | 1.20 | 1.80 | 1.20 | 1.80 |
| | Magenta coupler | (a) 0.32 | (o) 0.28 | (u) 0.35 | (a) 0.32 | (u) 0.35 |
| | Colored image stabilizer | (b) 0.06 | (p) 0.06 | (c) 0.20 | (b) 0.06 | (c) 0.20 |
| | | (c) 0.13 | (c) 0.09 | | (c) 0.13) | |

TABLE 10-continued

| Layer | Principal Components | Amounts Coated | | | | |
|---|---|---|---|---|---|---|
| | | Samples h, i | Samples j, k | Samples l, m | Samples n, o | Samples p, q |
| | Solvent | (d) 0.42 | (q) 0.42 | (i) 0.60 | (d) 0.42 | (i) 0.60 |

The amounts of silver halide emulsion are indicated as the coated amount (grams/$m^2$) calculated as silver. The other numerical values indicate the amounts coated in grams/$m^2$, except in the case of solvents where the amounts coated are indicated in terms of volume (ml/$m^2$).

TABLE 11

| Sample | Blue Sensitive Layer Emulsion | Green Sensitive Layer Emulsion | Red Sensitive layer Emulsion | Remarks |
|---|---|---|---|---|
| h | L-2 | E-4 | O-4 | Comparative Example |
| i | L-2 | E-3 | O-3 | This Invention |
| j | L-2 | E-4 | O-4 | Comparative Example |
| k | L-3 | E-3 | O-3 | This Invention |
| l | L-2 | E-4 | O-4 | Comparative Example |
| m | L-3 | E-3 | O-3 | This Invention |
| n | L-2 | E-4 | O-4 | Comparative Example |
| o | L-3 | E-3 | O-3 | This Invention |
| p | L-2 | E-4 | O-3 | Comparative Example |
| q | L-3 | E-3 | O-3 | This Invention |

It is possible, by means of this invention, to obtain excellent color photographic materials which have high speed and high contrast, which exhibit little reciprocity law failure and which have good latent image stability.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one photosensitive emulsion layer which contains silver halide grains on a support, wherein:

(1) said silver halide grains are prepared in the presence of iridium compounds, (2) said silver halide grains consist of silver chlorobromide which is substantially free of silver iodide, (3) at least 90 mol% of all silver halide from which said silver halide grains are made is silver chloride, (4) said silver halide grains have a localized phase in which silver bromide content exceeds at least 90 mol%, (5) said localized phase is precipitated together with at least 50% of all the iridium which is added during the preparation of said silver halide grains, and (6) the surface of said silver halide grains is chemically sensitized to the extent that the grains are substantially of the surface latent image type.

2. The silver halide photographic material of claim 1, wherein at least 95 mol% of all silver halide from which said silver halide grains are made is silver chloride.

3. The silver halide photographic material of claim 1, wherein the localized phase in which the silver bromide content exceeds at least 20 mol% is grown epitaxially on the surfaces of silver halide grains.

4. The silver halide photographic material of claim 1, wherein said silver halide grains have a localized phase in which the silver bromide content is within the range of from 20 to 60 mol%.

5. The silver halide photographic material of claim 4, wherein said silver halide grains have a localized phase in which the silver bromide content is within the range of from 30 to 50 mol%.

6. The silver halide photographic material of claim 1, wherein the localized phase is precipitated together with at least 80% of all of the iridium which is added during the preparation of said silver halide grains.

7. The silver halide photographic material of claim 6, wherein the localized phase is precipitated together with all of the iridium which is added during the preparation of said silver halide grains.

8. The silver halide photographic material of claim 1, wherein the surface of the silver halide grains is chemically sensitized using a sulfur sensitization method.

9. The silver halide photographic material of claim 1, wherein a doping of iridium to the silver halide grains is taken place by adding and dissolving other silver halide grains which have been doped with iridium therein.

10. The silver halide photographic material of claim 1, wherein the localized phase of the silver halide grains is formed by adding fine silver bromide grains or silver chlorobromide grains thereto.

11. The silver halide photographic material of claim 1, wherein the localized phase of the silver halide grains is formed by adding fine silver bromide grains or silver chlorobromide grains thereto which have been doped with iridium.

12. The silver halide photographic material of claim 1, wherein said material contains at least one of mercaptoazoles having formulae (I), (II) and (III),

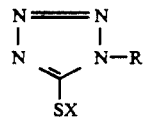

(I)

where R represents an alkyl group, an alkenyl group or an aryl group; and X represents a hydrogen atom, an alkali metal atom, an ammonium group or a precursor thereof,

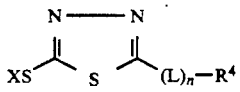

(II)

wherein L represents a divalent linking group; $R^4$ represents a hydrogen atom, an alkyl group, an alkenyl group or an aryl group; and X is as defined above,

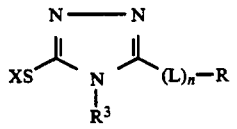

(III)

wherein R, X, and L are defined above; and $R^3$ has the same meaning as R and these groups may be the same or different.

13. The silver halide photographic material of claim 1, wherein a red sensitizing dye having a reduction potential of −1.23 or more negative in terms of V vs S.C.E. is contained.

14. The silver halide photographic material of claim 1, wherein a red sensitizing dye having a reduction potential of −1.27 or more negative in terms of V vs S.C.E. is contained.

* * * * *

UNITED STATES PATENT AND TRADEMARK OFFICE

CERTIFICATE OF CORRECTION

PATENT NO. : 5,284,743

DATED : February 8, 1994

INVENTOR(S) : Naoto Ohshima et al

It is certified that error appears in the above-indentified patent and that said Letters Patent is hereby corrected as shown below:

Claim 1, ¶(4) at Col. 55, line 42, delete "90" and insert --20--.

Signed and Sealed this

Second Day of August, 1994

Bruce Lehman

*Attest:*

BRUCE LEHMAN

*Attesting Officer*

*Commissioner of Patents and Trademarks*